US009803902B2

(12) United States Patent
Pham

(10) Patent No.: US 9,803,902 B2
(45) Date of Patent: Oct. 31, 2017

(54) SYSTEM FOR REFRIGERANT CHARGE VERIFICATION USING TWO CONDENSER COIL TEMPERATURES

(71) Applicant: Emerson Climate Technologies, Inc., Sidney, OH (US)

(72) Inventor: Hung M. Pham, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 105 days.

(21) Appl. No.: 14/193,568

(22) Filed: Feb. 28, 2014

(65) Prior Publication Data

US 2014/0260342 A1 Sep. 18, 2014

Related U.S. Application Data

(60) Provisional application No. 61/789,913, filed on Mar. 15, 2013.

(51) Int. Cl.
*F25B 45/00* (2006.01)
*F25B 39/04* (2006.01)
(Continued)

(52) U.S. Cl.
CPC ..... *F25B 45/00* (2013.01); *F25B 39/04* (2013.01); *F25B 40/02* (2013.01); *F25B 40/04* (2013.01);
(Continued)

(58) Field of Classification Search
CPC ..... F25B 2500/22; F25B 2500/222; F25B 2600/19; F25B 2700/2116;
(Continued)

(56) References Cited

U.S. PATENT DOCUMENTS 2,296,822 A 9/1942 Wolfert
2,804,839 A 9/1957 Hallinan
(Continued)

FOREIGN PATENT DOCUMENTS

CA 1147440 A1 5/1983
CA 1151265 A1 8/1983
(Continued)

OTHER PUBLICATIONS

Second Office Action regarding Chinese Patent Application No. 200780030810X, dated Aug. 4, 2010. English translation provided by Unitalen Attorneys at Law.
(Continued)

*Primary Examiner* — David Teitelbaum
(74) *Attorney, Agent, or Firm* — Harness, Dickey & Pierce, P.L.C.

(57) ABSTRACT

A charge-verification system for a circuit including a condenser having an inlet, an outlet, and a coil circuit tube extending between the inlet and the outlet is provided. The charge-verification system may include a first of coil temperature sensor located on the coil circuit tube a first distance from the inlet and a second of coil temperature sensor located on the coil circuit tube a second distance from the inlet. The charge-verification system may also include a controller receiving a first signal from the first temperature sensor indicative of a first temperature and a second signal from the second temperature sensor indicative of a second temperature. The controller may determine which of the first signal and the second signal is closer to an actual saturated condensing temperature of the condenser.

19 Claims, 7 Drawing Sheets

(51) Int. Cl.
*F25B 40/02* (2006.01)
*F25B 40/04* (2006.01)
*F25B 49/00* (2006.01)

(52) U.S. Cl.
CPC ..... *F25B 49/005* (2013.01); *F25B 2500/22* (2013.01); *F25B 2500/222* (2013.01); *F25B 2500/23* (2013.01); *F25B 2500/24* (2013.01); *F25B 2600/19* (2013.01); *F25B 2700/04* (2013.01); *F25B 2700/2106* (2013.01); *F25B 2700/21162* (2013.01); *F25B 2700/21163* (2013.01)

(58) Field of Classification Search
CPC .. F25B 2700/21162; F25B 2700/21163; F25B 40/02; F25B 40/04; F25B 39/04; F25B 45/00
USPC ..... 62/292, 77, 174
See application file for complete search history.

(56) References Cited

U.S. PATENT DOCUMENTS 2,961,606 A 11/1960 Mead
2,962,702 A 11/1960 Derr et al.
3,027,865 A 4/1962 Kautz et al.
3,082,951 A 3/1963 Kayan
3,400,374 A 9/1968 Schumann
3,513,662 A 5/1970 Golber
3,581,281 A 5/1971 Martin et al.
3,585,451 A 6/1971 Day, III
3,653,783 A 4/1972 Sauder
3,697,953 A 10/1972 Schoenwitz
3,707,851 A 1/1973 McAshan, Jr.
3,767,328 A 10/1973 Ladusaw
3,820,074 A 6/1974 Toman
3,882,305 A 5/1975 Johnstone
3,924,972 A 12/1975 Szymaszek
4,006,460 A 2/1977 Hewitt et al.
4,019,172 A 4/1977 Srodes
4,027,289 A 5/1977 Toman
RE29,450 E 10/1977 Goldsby et al.
4,102,150 A 7/1978 Kountz
4,132,086 A 1/1979 Kountz
4,151,725 A 5/1979 Kountz et al.
4,153,003 A 5/1979 Willis
4,178,988 A 12/1979 Cann et al.
4,197,717 A 4/1980 Schumacher
4,205,381 A 5/1980 Games et al.
4,217,761 A 8/1980 Cornaire et al.
4,270,174 A 5/1981 Karlin et al.
4,281,358 A 7/1981 Plouffe et al.
4,284,849 A 8/1981 Anderson et al.
4,296,727 A 10/1981 Bryan
4,306,293 A 12/1981 Marathe
4,308,725 A 1/1982 Chiyoda
4,321,529 A 3/1982 Simmonds et al.
4,346,755 A 8/1982 Alley et al.
4,351,163 A 9/1982 Johannsen
4,387,578 A 6/1983 Paddock
4,390,058 A 6/1983 Otake et al.
4,402,054 A 8/1983 Osborne et al.
4,415,896 A 11/1983 Allgood
4,418,388 A 11/1983 Allgor et al.
4,420,947 A 12/1983 Yoshino
4,432,232 A 2/1984 Brantley et al.
4,434,390 A 2/1984 Elms
4,451,929 A 5/1984 Yoshida
4,463,574 A 8/1984 Spethmann et al.
4,463,576 A 8/1984 Burnett et al.
4,474,542 A 10/1984 Kato et al.
4,484,452 A * 11/1984 Houser, Jr. ..... F25B 13/00 62/149
4,490,986 A 1/1985 Paddock
4,494,383 A 1/1985 Nagatomo et al.
4,505,125 A 3/1985 Baglione
4,517,468 A 5/1985 Kemper et al.
4,527,247 A 7/1985 Kaiser et al.
4,540,040 A 9/1985 Fukumoto et al.
4,550,770 A 11/1985 Nussdorfer et al.
4,553,400 A 11/1985 Branz
4,555,910 A 12/1985 Sturges
4,558,181 A 12/1985 Blanchard et al.
4,563,878 A 1/1986 Baglione
4,567,733 A 2/1986 Mecozzi
4,568,909 A 2/1986 Whynacht
4,575,318 A 3/1986 Blain
4,577,977 A 3/1986 Pejsa
4,593,367 A 6/1986 Slack et al.
4,603,556 A 8/1986 Suefuji et al.
4,604,036 A 8/1986 Sutou et al.
4,620,286 A 10/1986 Smith et al.
4,626,753 A 12/1986 Letterman
4,630,572 A 12/1986 Evans
4,642,782 A 2/1987 Kemper et al.
4,644,479 A 2/1987 Kemper et al.
4,648,044 A 3/1987 Hardy et al.
4,649,515 A 3/1987 Thompson et al.
4,660,386 A 4/1987 Hansen et al.
4,677,830 A * 7/1987 Sumikawa ..... B60H 1/3225 62/126
4,685,615 A 8/1987 Hart
4,703,325 A 10/1987 Chamberlin et al.
4,715,792 A 12/1987 Nishizawa et al.
4,716,582 A 12/1987 Blanchard et al.
4,716,957 A 1/1988 Thompson et al.
4,751,501 A 6/1988 Gut
4,754,410 A 6/1988 Leech et al.
4,768,346 A 9/1988 Mathur
4,783,752 A 11/1988 Kaplan et al.
4,787,213 A 11/1988 Gras et al.
4,796,142 A 1/1989 Libert
4,796,466 A 1/1989 Farmer
4,831,832 A 5/1989 Alsenz
4,831,833 A 5/1989 Duenes et al.
4,835,706 A 5/1989 Asahi
4,838,037 A 6/1989 Wood
4,841,734 A * 6/1989 Torrence ..... B60H 1/00978 374/27
4,843,575 A 6/1989 Crane
4,853,693 A 8/1989 Eaton-Williams
4,866,635 A 9/1989 Kahn et al.
4,875,589 A 10/1989 Lacey et al.
4,882,747 A 11/1989 Williams
4,903,759 A 2/1990 Lapeyrouse
4,904,993 A 2/1990 Sato
4,916,633 A 4/1990 Tychonievich et al.
4,916,909 A 4/1990 Mathur et al.
4,918,690 A 4/1990 Markkula, Jr. et al.
4,924,404 A 5/1990 Reinke, Jr.
4,924,418 A 5/1990 Bachman et al.
4,928,750 A 5/1990 Nurczyk
4,948,040 A 8/1990 Kobayashi et al.
4,949,550 A 8/1990 Hanson
4,964,125 A 10/1990 Kim
4,974,427 A 12/1990 Diab
4,990,893 A 2/1991 Kiluk
5,005,365 A 4/1991 Lynch
5,009,074 A 4/1991 Goubeaux et al.
5,018,357 A 5/1991 Livingstone et al.
5,022,234 A 6/1991 Goubeaux et al.
5,039,009 A 8/1991 Baldwin et al.
5,051,720 A 9/1991 Kittirutsunetorn
5,067,099 A 11/1991 McCown et al.
5,070,468 A 12/1991 Niinomi et al.
5,083,438 A 1/1992 McMullin
5,086,385 A 2/1992 Launey et al.
5,088,297 A 2/1992 Maruyama et al.
5,099,654 A 3/1992 Baruschke et al.
5,107,500 A 4/1992 Wakamoto et al.
5,109,222 A 4/1992 Welty
5,109,916 A 5/1992 Thompson
5,115,967 A 5/1992 Wedekind
5,123,017 A 6/1992 Simpkins et al.

(56) References Cited

U.S. PATENT DOCUMENTS 5,123,253 A 6/1992 Hanson et al.
5,131,237 A 7/1992 Valbjorn
5,136,855 A 8/1992 Lenarduzzi
5,140,394 A 8/1992 Cobb, III et al.
5,150,584 A * 9/1992 Tomasov ..... F25B 49/005 62/126
5,156,539 A 10/1992 Anderson et al.
5,181,389 A 1/1993 Hanson et al.
5,197,666 A 3/1993 Wedekind
5,200,987 A 4/1993 Gray
5,203,179 A 4/1993 Powell
5,224,354 A 7/1993 Ito et al.
5,226,472 A 7/1993 Benevelli et al.
5,228,304 A 7/1993 Ryan
5,230,223 A 7/1993 Hullar et al.
5,241,664 A 8/1993 Ohba et al.
5,243,827 A 9/1993 Hagita et al.
5,245,833 A 9/1993 Mei et al.
5,251,453 A 10/1993 Stanke et al.
5,255,977 A 10/1993 Eimer et al.
5,265,434 A 11/1993 Alsenz
5,269,458 A 12/1993 Sol
5,274,571 A 12/1993 Hesse et al.
5,282,728 A 2/1994 Swain
5,284,026 A 2/1994 Powell
5,289,362 A 2/1994 Liebl et al.
5,303,112 A 4/1994 Zulaski et al.
5,311,562 A 5/1994 Palusamy et al.
5,316,448 A 5/1994 Ziegler et al.
5,337,576 A 8/1994 Dorfman et al.
5,347,476 A 9/1994 McBean, Sr.
5,351,037 A 9/1994 Martell et al.
5,369,958 A 12/1994 Kasai et al.
5,395,042 A 3/1995 Riley et al.
5,410,230 A 4/1995 Bessler et al.
5,415,008 A 5/1995 Bessler
5,426,952 A 6/1995 Bessler
5,431,026 A 7/1995 Jaster
5,432,500 A 7/1995 Scripps
5,435,145 A 7/1995 Jaster
5,435,148 A 7/1995 Sandofsky et al.
5,440,891 A 8/1995 Hindmon, Jr. et al.
5,450,359 A 9/1995 Sharma et al.
5,452,291 A 9/1995 Eisenhandler et al.
5,457,965 A 10/1995 Blair et al.
5,467,011 A 11/1995 Hunt
5,467,264 A 11/1995 Rauch et al.
5,469,045 A 11/1995 Dove et al.
5,481,884 A 1/1996 Scoccia
5,495,722 A 3/1996 Manson et al.
5,515,267 A 5/1996 Alsenz
5,515,692 A 5/1996 Sterber et al.
5,519,301 A 5/1996 Yoshida et al.
5,519,337 A 5/1996 Casada
5,535,136 A 7/1996 Standifer
5,546,073 A 8/1996 Duff et al.
5,546,756 A 8/1996 Ali
5,546,757 A 8/1996 Whipple, III
5,555,195 A 9/1996 Jensen et al.
5,564,280 A 10/1996 Schilling et al.
5,566,084 A 10/1996 Cmar
5,570,085 A 10/1996 Bertsch
5,570,258 A 10/1996 Manning
5,572,643 A 11/1996 Judson
5,577,905 A 11/1996 Momber et al.
5,581,229 A 12/1996 Hunt
5,586,446 A 12/1996 Torimitsu
5,590,830 A 1/1997 Kettler et al.
5,600,960 A 2/1997 Schwedler et al.
5,602,749 A 2/1997 Vosburgh
5,602,761 A 2/1997 Spoerre et al.
5,635,896 A 6/1997 Tinsley et al.
5,643,482 A 7/1997 Sandelman et al.
5,650,936 A 7/1997 Loucks et al.
5,651,263 A 7/1997 Nonaka et al.
5,655,380 A 8/1997 Calton
5,656,765 A 8/1997 Gray
5,666,815 A 9/1997 Aloise
5,682,949 A 11/1997 Ratcliffe et al.
5,684,463 A 11/1997 Diercks et al.
5,694,010 A 12/1997 Oomura et al.
5,696,501 A 12/1997 Ouellette et al.
5,706,007 A 1/1998 Fragnito et al.
5,711,785 A 1/1998 Maxwell
5,714,931 A 2/1998 Petite et al.
5,715,704 A 2/1998 Cholkeri et al.
5,718,822 A 2/1998 Richter
5,724,571 A 3/1998 Woods
5,729,474 A 3/1998 Hildebrand et al.
5,743,109 A 4/1998 Schulak
5,745,114 A 4/1998 King et al.
5,751,916 A 5/1998 Kon et al.
5,752,385 A 5/1998 Nelson
5,757,664 A 5/1998 Rogers et al.
5,757,892 A 5/1998 Blanchard et al.
5,761,083 A 6/1998 Brown, Jr. et al.
5,764,509 A 6/1998 Gross et al.
5,782,101 A 7/1998 Dennis
5,790,898 A 8/1998 Kishima et al.
5,802,860 A 9/1998 Barrows
5,805,856 A 9/1998 Hanson
5,810,908 A 9/1998 Gray et al.
5,812,061 A 9/1998 Simons
5,827,963 A 10/1998 Selegatto et al.
5,839,094 A 11/1998 French
5,839,291 A 11/1998 Chang et al.
5,841,654 A 11/1998 Verissimo et al.
5,860,286 A 1/1999 Tulpule
5,861,807 A 1/1999 Leyden et al.
5,867,998 A 2/1999 Guertin
5,873,257 A 2/1999 Peterson
5,875,430 A 2/1999 Koether
5,887,786 A 3/1999 Sandelman
5,900,801 A 5/1999 Heagle et al.
5,904,049 A 5/1999 Jaster et al.
5,918,200 A 6/1999 Tsutsui et al.
5,924,486 A 7/1999 Ehlers et al.
5,926,103 A 7/1999 Petite
5,926,531 A 7/1999 Petite
5,930,773 A 7/1999 Crooks et al.
5,934,087 A 8/1999 Watanabe et al.
5,939,974 A 8/1999 Heagle et al.
5,946,922 A 9/1999 Viard et al.
5,947,693 A 9/1999 Yang
5,949,677 A 9/1999 Ho
5,953,490 A 9/1999 Wiklund et al.
5,986,571 A 11/1999 Flick
6,006,142 A 12/1999 Seem et al.
6,006,171 A 12/1999 Vines et al.
6,013,108 A 1/2000 Karolys et al.
6,026,651 A 2/2000 Sandelman
6,028,522 A 2/2000 Petite
6,038,871 A 3/2000 Gutierrez et al.
6,041,856 A 3/2000 Thrasher et al.
6,044,062 A 3/2000 Brownrigg et al.
6,050,098 A 4/2000 Meyer et al.
6,052,731 A 4/2000 Holdsworth et al.
6,070,110 A 5/2000 Shah et al.
6,075,530 A 6/2000 Lucas et al.
6,088,659 A 7/2000 Kelley et al.
6,088,688 A 7/2000 Crooks et al.
6,095,674 A 8/2000 Verissimo et al.
6,098,893 A 8/2000 Berglund et al.
6,110,260 A 8/2000 Kubokawa
6,119,949 A 9/2000 Lindstrom
6,122,603 A 9/2000 Budike, Jr.
6,128,953 A 10/2000 Mizukoshi
6,138,461 A 10/2000 Park et al.
6,142,741 A 11/2000 Nishihata et al.
6,144,888 A 11/2000 Lucas et al.
6,145,328 A 11/2000 Choi
6,147,601 A 11/2000 Sandelman et al.
6,152,375 A 11/2000 Robison
6,152,376 A 11/2000 Sandelman et al.

(56) References Cited

U.S. PATENT DOCUMENTS

| | | | |
|---|---|---|---|
| 6,153,942 | A | 11/2000 | Roseman et al. |
| 6,154,488 | A | 11/2000 | Hunt |
| 6,160,477 | A | 12/2000 | Sandelman et al. |
| 6,169,979 | B1 | 1/2001 | Johnson |
| 6,176,683 | B1 | 1/2001 | Yang |
| 6,177,884 | B1 | 1/2001 | Hunt et al. |
| 6,178,362 | B1 | 1/2001 | Woolard et al. |
| 6,190,442 | B1 | 2/2001 | Redner |
| 6,191,545 | B1 | 2/2001 | Kawabata et al. |
| 6,192,282 | B1 | 2/2001 | Smith et al. |
| 6,211,782 | B1 | 4/2001 | Sandelman et al. |
| 6,213,731 | B1 | 4/2001 | Doepker et al. |
| 6,215,405 | B1 | 4/2001 | Handley et al. |
| 6,216,956 | B1 | 4/2001 | Ehlers et al. |
| 6,218,953 | B1 | 4/2001 | Petite |
| 6,223,543 | B1 | 5/2001 | Sandelman |
| 6,223,544 | B1 | 5/2001 | Seem |
| 6,228,155 | B1 | 5/2001 | Tai |
| 6,230,501 | B1 | 5/2001 | Bailey, Sr. et al. |
| 6,233,327 | B1 | 5/2001 | Petite |
| 6,234,019 | B1 | 5/2001 | Caldeira |
| 6,240,733 | B1 | 6/2001 | Brandon et al. |
| 6,240,736 | B1 | 6/2001 | Fujita et al. |
| 6,244,061 | B1 | 6/2001 | Takagi et al. |
| 6,249,516 | B1 | 6/2001 | Brownrigg et al. |
| 6,266,968 | B1 | 7/2001 | Redlich |
| 6,268,664 | B1 | 7/2001 | Rolls et al. |
| 6,272,868 | B1 | 8/2001 | Grabon et al. |
| 6,290,043 | B1 | 9/2001 | Ginder et al. |
| 6,293,114 | B1 | 9/2001 | Kamemoto |
| 6,304,934 | B1 | 10/2001 | Pimenta et al. |
| 6,320,275 | B1 | 11/2001 | Okamoto et al. |
| 6,327,541 | B1 | 12/2001 | Pitchford et al. |
| 6,334,093 | B1 | 12/2001 | More |
| 6,349,883 | B1 | 2/2002 | Simmons et al. |
| 6,366,889 | B1 | 4/2002 | Zaloom |
| 6,378,315 | B1 | 4/2002 | Gelber et al. |
| 6,385,510 | B1 | 5/2002 | Hoog et al. |
| 6,391,102 | B1 | 5/2002 | Bodden et al. |
| 6,393,848 | B2 | 5/2002 | Roh et al. |
| 6,397,606 | B1 | 6/2002 | Roh et al. |
| 6,397,612 | B1 | 6/2002 | Kernkamp et al. |
| 6,408,228 | B1 | 6/2002 | Seem et al. |
| 6,408,258 | B1 | 6/2002 | Richer |
| 6,414,594 | B1 | 7/2002 | Guerlain |
| 6,430,268 | B1 | 8/2002 | Petite |
| 6,433,791 | B2 | 8/2002 | Selli et al. |
| 6,437,691 | B1 | 8/2002 | Sandelman et al. |
| 6,437,692 | B1 | 8/2002 | Petite et al. |
| 6,451,210 | B1 | 9/2002 | Sivavec et al. |
| 6,454,177 | B1 | 9/2002 | Sasao et al. |
| 6,456,928 | B1 | 9/2002 | Johnson |
| 6,460,731 | B2 | 10/2002 | Estelle et al. |
| 6,462,654 | B1 | 10/2002 | Sandelman et al. |
| 6,463,747 | B1 | 10/2002 | Temple |
| 6,466,971 | B1 | 10/2002 | Humpleman et al. |
| 6,474,084 | B2 | 11/2002 | Gauthier et al. |
| 6,490,506 | B1 | 12/2002 | March |
| 6,505,087 | B1 | 1/2003 | Lucas et al. |
| 6,510,350 | B1 | 1/2003 | Steen, III et al. |
| 6,522,974 | B2 | 2/2003 | Sitton |
| 6,523,130 | B1 | 2/2003 | Hickman et al. |
| 6,526,766 | B1 | 3/2003 | Hiraoka et al. |
| 6,529,839 | B1 | 3/2003 | Uggerud et al. |
| 6,535,123 | B2 | 3/2003 | Sandelman et al. |
| 6,535,270 | B1 | 3/2003 | Murayama |
| 6,535,859 | B1 | 3/2003 | Yablonowski et al. |
| 6,549,135 | B2 | 4/2003 | Singh et al. |
| 6,553,774 | B1 | 4/2003 | Ishio et al. |
| 6,571,280 | B1 | 5/2003 | Hubacher |
| 6,571,566 | B1 | 6/2003 | Temple et al. |
| 6,574,561 | B2 | 6/2003 | Alexander et al. |
| 6,577,959 | B1 | 6/2003 | Chajec et al. |
| 6,577,962 | B1 | 6/2003 | Afshari |
| 6,578,373 | B1 | 6/2003 | Barbier |
| 6,583,720 | B1 | 6/2003 | Quigley |
| 6,591,620 | B2 | 7/2003 | Kikuchi et al. |
| 6,595,475 | B2 | 7/2003 | Svabek et al. |
| 6,598,056 | B1 | 7/2003 | Hull et al. |
| 6,604,093 | B1 | 8/2003 | Etzion et al. |
| 6,609,070 | B1 | 8/2003 | Lueck |
| 6,609,078 | B2 | 8/2003 | Starling et al. |
| 6,618,578 | B1 | 9/2003 | Petite |
| 6,618,709 | B1 | 9/2003 | Sneeringer |
| 6,621,443 | B1 | 9/2003 | Selli et al. |
| 6,622,925 | B2 | 9/2003 | Carner et al. |
| 6,622,926 | B1 | 9/2003 | Sartain et al. |
| 6,628,764 | B1 | 9/2003 | Petite |
| 6,630,749 | B1 | 10/2003 | Takagi et al. |
| 6,631,298 | B1 | 10/2003 | Pagnano et al. |
| 6,636,893 | B1 | 10/2003 | Fong |
| 6,643,567 | B2 | 11/2003 | Kolk et al. |
| 6,644,848 | B1 | 11/2003 | Clayton et al. |
| 6,658,345 | B2 | 12/2003 | Miller |
| 6,662,584 | B1 | 12/2003 | Whiteside |
| 6,662,653 | B1 | 12/2003 | Scaliante et al. |
| 6,671,586 | B2 | 12/2003 | Davis et al. |
| 6,684,349 | B2 | 1/2004 | Gullo et al. |
| 6,698,218 | B2 | 3/2004 | Goth et al. |
| 6,701,725 | B2 | 3/2004 | Rossi et al. |
| 6,708,083 | B2 | 3/2004 | Orthlieb et al. |
| 6,708,508 | B2 | 3/2004 | Demuth et al. |
| 6,711,470 | B1 | 3/2004 | Hartenstein et al. |
| 6,717,513 | B1 | 4/2004 | Sandelman et al. |
| 6,721,770 | B1 | 4/2004 | Morton et al. |
| 6,725,182 | B2 | 4/2004 | Pagnano et al. |
| 6,732,538 | B2 | 5/2004 | Trigiani et al. |
| 6,745,107 | B1 | 6/2004 | Miller |
| 6,747,557 | B1 | 6/2004 | Petite et al. |
| 6,757,665 | B1 | 6/2004 | Unsworth et al. |
| 6,758,050 | B2 | 7/2004 | Jayanth et al. |
| 6,772,096 | B2 | 8/2004 | Murakami et al. |
| 6,772,598 | B1 | 8/2004 | Rinehart |
| 6,775,995 | B1 | 8/2004 | Bahel et al. |
| 6,784,807 | B2 | 8/2004 | Petite et al. |
| 6,785,592 | B1 | 8/2004 | Smith et al. |
| 6,786,473 | B1 | 9/2004 | Alles |
| 6,804,993 | B2 | 10/2004 | Selli |
| 6,813,897 | B1 | 11/2004 | Bash et al. |
| 6,816,811 | B2 | 11/2004 | Seem |
| 6,836,737 | B2 | 12/2004 | Petite et al. |
| 6,837,922 | B2 | 1/2005 | Gorin |
| 6,839,790 | B2 | 1/2005 | Barros De Almeida et al. |
| 6,854,345 | B2 | 2/2005 | Alves et al. |
| 6,862,498 | B2 | 3/2005 | Davis et al. |
| 6,868,678 | B2 | 3/2005 | Mei et al. |
| 6,868,686 | B2 | 3/2005 | Ueda et al. |
| 6,870,486 | B2 | 3/2005 | Souza et al. |
| 6,885,949 | B2 | 4/2005 | Selli |
| 6,889,173 | B2 | 5/2005 | Singh |
| 6,891,838 | B1 | 5/2005 | Petite et al. |
| 6,892,546 | B2 | 5/2005 | Singh et al. |
| 6,897,772 | B1 | 5/2005 | Scheffler et al. |
| 6,900,738 | B2 | 5/2005 | Crichlow |
| 6,901,066 | B1 | 5/2005 | Helgeson |
| 6,904,385 | B1 | 6/2005 | Budike, Jr. |
| 6,914,533 | B2 | 7/2005 | Petite |
| 6,914,893 | B2 | 7/2005 | Petite |
| 6,922,155 | B1 | 7/2005 | Evans et al. |
| 6,931,445 | B2 | 8/2005 | Davis |
| 6,952,658 | B2 | 10/2005 | Greulich et al. |
| 6,953,630 | B2 | 10/2005 | Wells |
| 6,956,344 | B2 | 10/2005 | Robertson et al. |
| 6,968,295 | B1 | 11/2005 | Carr |
| 6,973,410 | B2 | 12/2005 | Seigel |
| 6,973,793 | B2 | 12/2005 | Douglas et al. |
| 6,976,366 | B2 | 12/2005 | Starling et al. |
| 6,978,225 | B2 | 12/2005 | Retlich et al. |
| 6,983,321 | B2 | 1/2006 | Trinon et al. |
| 6,983,889 | B2 | 1/2006 | Alles |
| 6,987,450 | B2 | 1/2006 | Marino et al. |
| 6,990,821 | B2 | 1/2006 | Singh et al. |
| 6,992,452 | B1 | 1/2006 | Sachs et al. |
| 6,996,441 | B1 | 2/2006 | Tobias |

(56) References Cited

U.S. PATENT DOCUMENTS

| | | | |
|---|---|---|---|
| 6,997,390 | B2 | 2/2006 | Alles |
| 6,998,807 | B2 | 2/2006 | Phillips et al. |
| 6,998,963 | B2 | 2/2006 | Flen et al. |
| 7,003,378 | B2 | 2/2006 | Poth |
| 7,009,510 | B1 | 3/2006 | Douglass et al. |
| 7,010,925 | B2 | 3/2006 | Sienel et al. |
| 7,019,667 | B2 | 3/2006 | Petite et al. |
| 7,024,665 | B2 | 4/2006 | Ferraz et al. |
| 7,024,870 | B2 | 4/2006 | Singh et al. |
| 7,030,752 | B2 | 4/2006 | Tyroler |
| 7,031,880 | B1 | 4/2006 | Seem et al. |
| 7,035,693 | B2 | 4/2006 | Cassiolato et al. |
| 7,039,532 | B2 | 5/2006 | Hunter |
| 7,042,350 | B2 | 5/2006 | Patrick et al. |
| 7,043,339 | B2 | 5/2006 | Maeda et al. |
| 7,043,459 | B2 | 5/2006 | Peevey |
| 7,053,766 | B2 | 5/2006 | Fisler et al. |
| 7,053,767 | B2 | 5/2006 | Petite et al. |
| 7,054,271 | B2 | 5/2006 | Brownrigg et al. |
| 7,062,580 | B2 | 6/2006 | Donaires |
| 7,062,830 | B2 | 6/2006 | Alles |
| 7,063,537 | B2 | 6/2006 | Selli et al. |
| 7,072,797 | B2 | 7/2006 | Gorinevsky |
| 7,075,327 | B2 | 7/2006 | Dimino et al. |
| 7,079,810 | B2 | 7/2006 | Petite et al. |
| 7,082,380 | B2 | 7/2006 | Wiebe et al. |
| 7,089,125 | B2 | 8/2006 | Sonderegger |
| 7,091,847 | B2 | 8/2006 | Capowski et al. |
| 7,092,767 | B2 | 8/2006 | Pagnano et al. |
| 7,092,794 | B1 | 8/2006 | Hill et al. |
| 7,096,153 | B2 | 8/2006 | Guralnik et al. |
| 7,102,490 | B2 | 9/2006 | Flen et al. |
| 7,103,511 | B2 | 9/2006 | Petite |
| 7,110,843 | B2 | 9/2006 | Pagnano et al. |
| 7,110,898 | B2 | 9/2006 | Montijo et al. |
| 7,114,343 | B2 | 10/2006 | Kates |
| 7,123,020 | B2 | 10/2006 | Hill et al. |
| 7,126,465 | B2 | 10/2006 | Faltesek |
| 7,130,832 | B2 | 10/2006 | Bannai et al. |
| 7,137,550 | B1 | 11/2006 | Petite |
| 7,142,125 | B2 | 11/2006 | Larson et al. |
| 7,145,438 | B2 | 12/2006 | Flen et al. |
| 7,145,462 | B2 | 12/2006 | Dewing et al. |
| 7,159,408 | B2 | 1/2007 | Sadegh et al. |
| 7,162,884 | B2 | 1/2007 | Alles |
| 7,163,158 | B2 | 1/2007 | Rossi et al. |
| 7,171,372 | B2 | 1/2007 | Daniel et al. |
| 7,180,412 | B2 | 2/2007 | Bonicatto et al. |
| 7,184,861 | B2 | 2/2007 | Petite |
| 7,188,482 | B2 | 3/2007 | Sadegh et al. |
| 7,188,779 | B2 | 3/2007 | Alles |
| 7,201,006 | B2 | 4/2007 | Kates |
| 7,207,496 | B2 | 4/2007 | Alles |
| 7,209,840 | B2 | 4/2007 | Petite et al. |
| 7,212,887 | B2 | 5/2007 | Shah et al |
| 7,222,493 | B2 | 5/2007 | Jayanth et al. |
| 7,224,740 | B2 | 5/2007 | Hunt |
| 7,225,193 | B2 | 5/2007 | Mets et al. |
| 7,227,450 | B2 | 6/2007 | Garvy et al. |
| 7,230,528 | B2 | 6/2007 | Kates |
| 7,234,313 | B2 | 6/2007 | Bell et al. |
| 7,236,765 | B2 | 6/2007 | Bonicatto et al. |
| 7,244,294 | B2 | 7/2007 | Kates |
| 7,246,014 | B2 | 7/2007 | Forth et al. |
| 7,255,285 | B2 | 8/2007 | Troost et al. |
| 7,257,501 | B2 | 8/2007 | Zhan et al. |
| 7,260,505 | B2 | 8/2007 | Felke et al. |
| 7,261,762 | B2 | 8/2007 | Kang et al. |
| 7,263,073 | B2 | 8/2007 | Petite et al. |
| 7,263,446 | B2 | 8/2007 | Morin et al. |
| 7,266,812 | B2 | 9/2007 | Pagnano |
| 7,274,995 | B2 | 9/2007 | Zhan et al. |
| 7,275,377 | B2 | 10/2007 | Kates |
| 7,286,945 | B2 | 10/2007 | Zhan et al. |
| 7,290,398 | B2 | 11/2007 | Wallace et al. |
| 7,295,128 | B2 | 11/2007 | Petite |
| 7,295,896 | B2 | 11/2007 | Norbeck |
| 7,317,952 | B2 | 1/2008 | Bhandiwad et al. |
| 7,328,192 | B1 | 2/2008 | Stengard et al. |
| 7,330,886 | B2 | 2/2008 | Childers et al. |
| 7,331,187 | B2 | 2/2008 | Kates |
| 7,336,168 | B2 | 2/2008 | Kates |
| 7,337,191 | B2 | 2/2008 | Haeberle et al. |
| 7,343,750 | B2 | 3/2008 | Lifson et al. |
| 7,343,751 | B2 | 3/2008 | Kates |
| 7,346,463 | B2 | 3/2008 | Petite et al. |
| 7,346,472 | B1 | 3/2008 | Moskowitz et al. |
| 7,349,824 | B2 | 3/2008 | Seigel |
| 7,350,112 | B2 | 3/2008 | Fox et al. |
| 7,351,274 | B2 | 4/2008 | Helt et al. |
| 7,363,200 | B2 | 4/2008 | Lu |
| 7,376,712 | B1 | 5/2008 | Granatelli et al. |
| 7,377,118 | B2 | 5/2008 | Esslinger |
| 7,383,030 | B2 | 6/2008 | Brown et al. |
| 7,383,158 | B2 | 6/2008 | Krocker et al. |
| 7,392,661 | B2 | 7/2008 | Alles |
| 7,397,907 | B2 | 7/2008 | Petite |
| 7,400,240 | B2 | 7/2008 | Shrode et al. |
| 7,414,525 | B2 | 8/2008 | Costea et al. |
| 7,421,351 | B2 | 9/2008 | Navratil |
| 7,421,374 | B2 | 9/2008 | Zhan et al. |
| 7,424,343 | B2 | 9/2008 | Kates |
| 7,424,345 | B2 | 9/2008 | Norbeck |
| 7,424,527 | B2 | 9/2008 | Petite |
| 7,432,824 | B2 | 10/2008 | Flen et al. |
| 7,433,854 | B2 | 10/2008 | Joseph et al. |
| 7,434,742 | B2 | 10/2008 | Mueller et al. |
| 7,437,150 | B1 | 10/2008 | Morelli et al. |
| 7,440,560 | B1 | 10/2008 | Barry |
| 7,440,767 | B2 | 10/2008 | Ballay et al. |
| 7,443,313 | B2 | 10/2008 | Davis et al. |
| 7,444,251 | B2 | 10/2008 | Nikovski et al. |
| 7,445,665 | B2 | 11/2008 | Hsieh et al. |
| 7,447,609 | B2 | 11/2008 | Guralnik et al. |
| 7,451,606 | B2 | 11/2008 | Harrod |
| 7,454,439 | B1 | 11/2008 | Gansner et al. |
| 7,468,661 | B2 | 12/2008 | Petite et al. |
| 7,469,546 | B2 | 12/2008 | Kates |
| 7,474,992 | B2 | 1/2009 | Ariyur |
| 7,480,501 | B2 | 1/2009 | Petite |
| 7,483,810 | B2 | 1/2009 | Jackson et al. |
| 7,490,477 | B2 | 2/2009 | Singh et al. |
| 7,503,182 | B2 | 3/2009 | Bahel et al. |
| 7,510,126 | B2 | 3/2009 | Rossi et al. |
| 7,523,619 | B2 | 4/2009 | Kojima et al. |
| 7,528,711 | B2 | 5/2009 | Kates |
| 7,533,070 | B2 | 5/2009 | Guralnik et al. |
| 7,537,172 | B2 | 5/2009 | Rossi et al. |
| 7,552,030 | B2 | 6/2009 | Guralnik et al. |
| 7,552,596 | B2 | 6/2009 | Galante et al. |
| 7,555,364 | B2 | 6/2009 | Poth et al. |
| 7,574,333 | B2 | 8/2009 | Lu |
| 7,580,812 | B2 | 8/2009 | Ariyur et al. |
| 7,594,407 | B2 | 9/2009 | Singh et al. |
| 7,596,959 | B2 | 10/2009 | Singh et al. |
| 7,606,683 | B2 | 10/2009 | Bahel et al. |
| 7,631,508 | B2 | 12/2009 | Braun et al. |
| 7,636,901 | B2 | 12/2009 | Munson et al. |
| 7,644,591 | B2 | 1/2010 | Singh et al. |
| 7,648,077 | B2 | 1/2010 | Rossi et al. |
| 7,650,425 | B2 | 1/2010 | Davis et al. |
| 7,660,700 | B2 | 2/2010 | Moskowitz et al. |
| 7,660,774 | B2 | 2/2010 | Mukherjee et al. |
| 7,664,613 | B2 | 2/2010 | Hansen |
| 7,665,315 | B2 | 2/2010 | Singh et al. |
| 7,686,872 | B2 | 3/2010 | Kang |
| 7,693,809 | B2 | 4/2010 | Gray |
| 7,697,492 | B2 | 4/2010 | Petite |
| 7,703,694 | B2 | 4/2010 | Mueller et al. |
| 7,704,052 | B2 | 4/2010 | Iimura et al. |
| 7,706,320 | B2 | 4/2010 | Davis et al. |
| 7,724,131 | B2 | 5/2010 | Chen |
| 7,726,583 | B2 | 6/2010 | Maekawa |
| 7,734,451 | B2 | 6/2010 | MacArthur et al. |

(56) References Cited

U.S. PATENT DOCUMENTS

| | | | |
|---|---|---|---|
| 7,738,999 | B2 | 6/2010 | Petite |
| 7,739,378 | B2 | 6/2010 | Petite |
| 7,742,393 | B2 | 6/2010 | Bonicatto et al. |
| 7,752,853 | B2 | 7/2010 | Singh et al. |
| 7,752,854 | B2 | 7/2010 | Singh et al. |
| 7,756,086 | B2 | 7/2010 | Petite et al. |
| 7,791,468 | B2 | 9/2010 | Bonicatto et al. |
| 7,844,366 | B2 | 11/2010 | Singh |
| 7,845,179 | B2 | 12/2010 | Singh et al. |
| 7,848,827 | B2 | 12/2010 | Chen |
| 7,848,900 | B2 | 12/2010 | Steinberg et al. |
| 7,877,218 | B2 | 1/2011 | Bonicatto et al. |
| 7,878,006 | B2 | 2/2011 | Pham |
| 7,885,959 | B2 | 2/2011 | Horowitz et al. |
| 7,885,961 | B2 | 2/2011 | Horowitz et al. |
| 7,905,098 | B2 | 3/2011 | Pham |
| 7,908,116 | B2 | 3/2011 | Steinberg et al. |
| 7,908,117 | B2 | 3/2011 | Steinberg et al. |
| 7,922,914 | B1 | 4/2011 | Verdegan et al. |
| 7,937,623 | B2 | 5/2011 | Ramacher et al. |
| 7,941,294 | B2 | 5/2011 | Shahi et al. |
| 7,949,494 | B2 | 5/2011 | Moskowitz et al. |
| 7,949,615 | B2 | 5/2011 | Ehlers et al. |
| 7,963,454 | B2 | 6/2011 | Sullivan et al. |
| 7,966,152 | B2 | 6/2011 | Stluka et al. |
| 7,967,218 | B2 | 6/2011 | Alles |
| 7,978,059 | B2 | 7/2011 | Petite et al. |
| 7,987,679 | B2 | 8/2011 | Tanaka et al. |
| 7,996,045 | B1 | 8/2011 | Bauer et al. |
| 7,999,668 | B2 | 8/2011 | Cawthorne et al. |
| 8,000,314 | B2 | 8/2011 | Brownrigg et al. |
| 8,002,199 | B2 | 8/2011 | Habegger |
| 8,005,640 | B2 | 8/2011 | Chiefetz et al. |
| 8,010,237 | B2 | 8/2011 | Cheung et al. |
| 8,013,732 | B2 | 9/2011 | Petite et al. |
| 8,018,182 | B2 | 9/2011 | Roehm et al. |
| 8,019,567 | B2 | 9/2011 | Steinberg et al. |
| 8,029,608 | B1 | 10/2011 | Breslin |
| 8,031,455 | B2 | 10/2011 | Paik et al. |
| 8,031,650 | B2 | 10/2011 | Petite et al. |
| 8,034,170 | B2 | 10/2011 | Kates |
| 8,036,844 | B2 | 10/2011 | Ling et al. |
| 8,040,231 | B2 | 10/2011 | Kuruvila et al. |
| 8,041,539 | B2 | 10/2011 | Guralnik et al. |
| 8,046,107 | B2 | 10/2011 | Zugibe et al. |
| 8,061,417 | B2 | 11/2011 | Gray |
| 8,064,412 | B2 | 11/2011 | Petite |
| 8,065,886 | B2 | 11/2011 | Singh et al. |
| 8,068,997 | B2 | 11/2011 | Ling et al. |
| 8,090,477 | B1 | 1/2012 | Steinberg |
| 8,090,559 | B2 | 1/2012 | Parthasarathy et al. |
| 8,090,824 | B2 | 1/2012 | Tran et al. |
| 8,095,337 | B2 | 1/2012 | Kolbet et al. |
| 8,108,200 | B2 | 1/2012 | Anne et al. |
| 8,125,230 | B2 | 2/2012 | Bharadwaj et al. |
| 8,131,497 | B2 | 3/2012 | Steinberg et al. |
| 8,131,506 | B2 | 3/2012 | Steinberg et al. |
| 8,134,330 | B2 | 3/2012 | Alles |
| 8,150,720 | B2 | 4/2012 | Singh et al. |
| 8,156,208 | B2 | 4/2012 | Bornhoevd et al. |
| 8,160,827 | B2 | 4/2012 | Jayanth et al. |
| 8,170,968 | B2 | 5/2012 | Colclough et al. |
| 8,171,136 | B2 | 5/2012 | Petite |
| 8,175,846 | B2 | 5/2012 | Khalak et al. |
| 8,180,492 | B2 | 5/2012 | Steinberg |
| 8,182,579 | B2 | 5/2012 | Woo et al. |
| 8,214,175 | B2 | 7/2012 | Moskowitz et al. |
| 8,239,922 | B2 | 8/2012 | Sullivan et al. |
| 8,258,763 | B2 | 9/2012 | Nakamura et al. |
| 8,280,536 | B1 | 10/2012 | Fadell et al. |
| 8,328,524 | B2 | 12/2012 | Iimura et al. |
| 8,335,657 | B2 | 12/2012 | Jayanth et al. |
| 8,380,556 | B2 | 2/2013 | Singh et al. |
| 8,625,244 | B2 | 1/2014 | Paik et al. |
| 9,168,315 | B1 | 10/2015 | Scaringe et al. |
| 9,310,439 | B2 | 4/2016 | Pham et al. |
| 2001/0054291 | A1 | 12/2001 | Roh et al. |
| 2002/0000092 | A1 | 1/2002 | Sharood et al. |
| 2002/0013679 | A1 | 1/2002 | Petite |
| 2002/0016639 | A1 | 2/2002 | Smith et al. |
| 2002/0017057 | A1 | 2/2002 | Weder |
| 2002/0031101 | A1 | 3/2002 | Petite et al. |
| 2002/0035495 | A1 | 3/2002 | Spira et al. |
| 2002/0059803 | A1 | 5/2002 | Jayanth |
| 2002/0082747 | A1 | 6/2002 | Kramer |
| 2002/0082924 | A1 | 6/2002 | Koether |
| 2002/0095269 | A1 | 7/2002 | Natalini et al. |
| 2002/0103655 | A1 | 8/2002 | Boies et al. |
| 2002/0113877 | A1 | 8/2002 | Welch |
| 2002/0118106 | A1 | 8/2002 | Brenn |
| 2002/0138217 | A1 | 9/2002 | Shen et al. |
| 2002/0139128 | A1 | 10/2002 | Suzuki et al. |
| 2002/0143482 | A1 | 10/2002 | Karanam et al. |
| 2002/0152298 | A1 | 10/2002 | Kikta et al. |
| 2002/0157409 | A1 | 10/2002 | Pham et al. |
| 2002/0161545 | A1 | 10/2002 | Starling et al. |
| 2002/0163436 | A1 | 11/2002 | Singh et al. |
| 2002/0170299 | A1 | 11/2002 | Jayanth et al. |
| 2002/0173929 | A1 | 11/2002 | Seigel |
| 2002/0189267 | A1 | 12/2002 | Singh et al. |
| 2002/0193890 | A1 | 12/2002 | Pouchak |
| 2002/0198629 | A1 | 12/2002 | Ellis |
| 2003/0004660 | A1 | 1/2003 | Hunter |
| 2003/0004765 | A1 | 1/2003 | Wiegand |
| 2003/0005710 | A1 | 1/2003 | Singh et al. |
| 2003/0006884 | A1 | 1/2003 | Hunt |
| 2003/0014218 | A1 | 1/2003 | Trigiani et al. |
| 2003/0019221 | A1 | 1/2003 | Rossi et al. |
| 2003/0036810 | A1 | 2/2003 | Petite |
| 2003/0050737 | A1 | 3/2003 | Osann |
| 2003/0050824 | A1 | 3/2003 | Suermondt et al. |
| 2003/0051490 | A1 | 3/2003 | Jayanth |
| 2003/0055603 | A1 | 3/2003 | Rossi et al. |
| 2003/0055663 | A1 | 3/2003 | Struble |
| 2003/0061825 | A1 | 4/2003 | Sullivan |
| 2003/0070438 | A1 | 4/2003 | Kikuchi et al. |
| 2003/0070544 | A1 | 4/2003 | Mulvaney et al. |
| 2003/0074285 | A1 | 4/2003 | Hoffman et al. |
| 2003/0077179 | A1 | 4/2003 | Collins et al. |
| 2003/0078677 | A1 | 4/2003 | Hull et al. |
| 2003/0089493 | A1 | 5/2003 | Takano et al. |
| 2003/0135786 | A1 | 7/2003 | Vollmar et al. |
| 2003/0137396 | A1 | 7/2003 | Durej et al. |
| 2003/0150924 | A1 | 8/2003 | Peter |
| 2003/0150926 | A1 | 8/2003 | Rosen |
| 2003/0150927 | A1 | 8/2003 | Rosen |
| 2003/0171851 | A1 | 9/2003 | Brickfield et al. |
| 2003/0183085 | A1 | 10/2003 | Alexander |
| 2003/0191606 | A1 | 10/2003 | Fujiyama et al. |
| 2003/0199247 | A1 | 10/2003 | Striemer |
| 2003/0205143 | A1 | 11/2003 | Cheng |
| 2003/0213256 | A1 | 11/2003 | Ueda et al. |
| 2003/0213851 | A1 | 11/2003 | Burd et al. |
| 2003/0216837 | A1 | 11/2003 | Reich et al. |
| 2003/0216888 | A1 | 11/2003 | Ridolfo |
| 2003/0233172 | A1 | 12/2003 | Granqvist et al. |
| 2004/0019584 | A1 | 1/2004 | Greening et al. |
| 2004/0026522 | A1 | 2/2004 | Keen et al. |
| 2004/0047406 | A1 | 3/2004 | Hunt |
| 2004/0049715 | A1 | 3/2004 | Jaw |
| 2004/0059691 | A1 | 3/2004 | Higgins |
| 2004/0068390 | A1 | 4/2004 | Saunders |
| 2004/0078695 | A1 | 4/2004 | Bowers et al. |
| 2004/0079093 | A1 | 4/2004 | Gauthier et al. |
| 2004/0095237 | A1 | 5/2004 | Chen et al. |
| 2004/0111186 | A1 | 6/2004 | Rossi et al. |
| 2004/0117166 | A1 | 6/2004 | Cassiolato |
| 2004/0133314 | A1 | 7/2004 | Ehlers et al. |
| 2004/0140772 | A1 | 7/2004 | Gullo et al. |
| 2004/0140812 | A1 | 7/2004 | Scallante et al. |
| 2004/0144106 | A1 | 7/2004 | Douglas et al. |
| 2004/0153437 | A1 | 8/2004 | Buchan |
| 2004/0159113 | A1 | 8/2004 | Singh et al. |
| 2004/0159114 | A1 | 8/2004 | Demuth et al. |

(56) References Cited

U.S. PATENT DOCUMENTS

2004/0183687 A1 9/2004 Petite et al.
2004/0199480 A1 10/2004 Unsworth et al.
2004/0210419 A1 10/2004 Wiebe et al.
2004/0213384 A1 10/2004 Alles et al.
2004/0230582 A1 11/2004 Pagnano et al.
2004/0230899 A1 11/2004 Pagnano et al.
2004/0239266 A1 12/2004 Lee et al.
2004/0261431 A1 12/2004 Singh et al.
2005/0043923 A1 2/2005 Forster et al.
2005/0056031 A1 3/2005 Jeong
2005/0066675 A1 3/2005 Manole et al.
2005/0073532 A1 4/2005 Scott et al.
2005/0086341 A1 4/2005 Enga et al.
2005/0125439 A1 6/2005 Nourbakhsh et al.
2005/0126190 A1 6/2005 Lifson et al.
2005/0131624 A1 6/2005 Gaessler et al.
2005/0149570 A1 7/2005 Sasaki et al.
2005/0154495 A1 7/2005 Shah
2005/0159924 A1 7/2005 Shah et al.
2005/0169636 A1 8/2005 Aronson et al.
2005/0172647 A1 8/2005 Thybo et al.
2005/0188842 A1 9/2005 Hsieh et al.
2005/0195775 A1 9/2005 Petite et al.
2005/0196285 A1 9/2005 Jayanth
2005/0198063 A1 9/2005 Thomas et al.
2005/0201397 A1 9/2005 Petite
2005/0204756 A1 9/2005 Dobmeier et al.
2005/0222715 A1 10/2005 Ruhnke et al.
2005/0228607 A1 10/2005 Simons
2005/0229612 A1 10/2005 Hrejsa et al.
2005/0229777 A1 10/2005 Brown et al.
2005/0235662 A1 10/2005 Pham
2005/0247194 A1 11/2005 Kang et al.
2005/0251293 A1 11/2005 Seigel
2005/0262923 A1 12/2005 Kates
2006/0010898 A1 1/2006 Suharno et al.
2006/0015777 A1 1/2006 Loda
2006/0020426 A1 1/2006 Singh
2006/0021362 A1 2/2006 Sadegh et al.
2006/0032246 A1 2/2006 Kates
2006/0032247 A1 2/2006 Kates
2006/0032248 A1 2/2006 Kates
2006/0032379 A1 2/2006 Kates
2006/0036349 A1 2/2006 Kates
2006/0041335 A9 2/2006 Rossi et al.
2006/0042276 A1 3/2006 Doll et al.
2006/0071089 A1 4/2006 Kates
2006/0071666 A1 4/2006 Unsworth et al.
2006/0074917 A1 4/2006 Chand et al.
2006/0097063 A1 5/2006 Zeevi
2006/0098576 A1 5/2006 Brownrigg et al.
2006/0123807 A1 6/2006 Sullivan et al.
2006/0130500 A1 6/2006 Gauthier et al.
2006/0137364 A1 6/2006 Braun et al.
2006/0137368 A1 6/2006 Kang et al.
2006/0138866 A1 6/2006 Bergmann et al.
2006/0140209 A1 6/2006 Cassiolato et al.
2006/0179854 A1 8/2006 Esslinger
2006/0182635 A1 8/2006 Jayanth
2006/0196196 A1 9/2006 Kates
2006/0196197 A1 9/2006 Kates
2006/0201168 A1 9/2006 Kates
2006/0229739 A1 10/2006 Morikawa
2006/0235650 A1 10/2006 Vinberg et al.
2006/0242200 A1 10/2006 Horowitz et al.
2006/0259276 A1 11/2006 Rossi et al.
2006/0271589 A1 11/2006 Horowitz et al.
2006/0271623 A1 11/2006 Horowitz et al.
2007/0006124 A1 1/2007 Ahmed et al.
2007/0027735 A1 2/2007 Rokos
2007/0067512 A1 3/2007 Donaires et al.
2007/0089434 A1 4/2007 Singh et al.
2007/0089435 A1 4/2007 Singh et al.
2007/0089438 A1 4/2007 Singh et al.
2007/0089439 A1 4/2007 Singh et al.
2007/0089440 A1 4/2007 Singh et al.
2007/0159978 A1 7/2007 Anglin et al.
2007/0186569 A1 8/2007 Street et al.
2007/0204635 A1 9/2007 Tanaka et al.
2007/0204921 A1 9/2007 Alles
2007/0205296 A1 9/2007 Bell et al.
2007/0229305 A1 10/2007 Bonicatto et al.
2007/0239894 A1 10/2007 Thind et al.
2008/0000241 A1 1/2008 Larsen et al.
2008/0015797 A1 1/2008 Kates
2008/0016888 A1 1/2008 Kates
2008/0051945 A1 2/2008 Kates
2008/0058970 A1 3/2008 Perumalsamy et al.
2008/0078289 A1 4/2008 Sergi et al.
2008/0109185 A1 5/2008 Cheung et al.
2008/0114569 A1 5/2008 Seigel
2008/0121729 A1 5/2008 Gray
2008/0183424 A1 7/2008 Seem
2008/0186898 A1 8/2008 Petite
2008/0209925 A1* 9/2008 Pham ..... F25B 49/005 62/126
2008/0216494 A1 9/2008 Pham et al.
2008/0216495 A1 9/2008 Kates
2008/0223051 A1 9/2008 Kates
2008/0234869 A1 9/2008 Yonezawa et al.
2008/0315000 A1 12/2008 Gorthala et al.
2008/0319688 A1 12/2008 Kim
2009/0007777 A1 1/2009 Cohen et al.
2009/0030555 A1 1/2009 Gray
2009/0037142 A1 2/2009 Kates
2009/0038010 A1 2/2009 Ma et al.
2009/0055465 A1 2/2009 DePue et al.
2009/0057424 A1 3/2009 Sullivan et al.
2009/0057428 A1 3/2009 Geadelmann et al.
2009/0068947 A1 3/2009 Petite
2009/0071175 A1 3/2009 Pham
2009/0072985 A1 3/2009 Patel et al.
2009/0093916 A1 4/2009 Parsonnet et al.
2009/0094998 A1* 4/2009 McSweeney ..... F25B 49/005 62/129
2009/0096605 A1 4/2009 Petite et al.
2009/0099699 A1 4/2009 Steinberg et al.
2009/0106601 A1 4/2009 Ngai et al.
2009/0112672 A1 4/2009 Flamig et al.
2009/0125151 A1 5/2009 Steinberg et al.
2009/0125257 A1 5/2009 Jayanth et al.
2009/0140880 A1 6/2009 Flen et al.
2009/0151374 A1 6/2009 Kasahara
2009/0187281 A1 7/2009 Kates
2009/0215424 A1 8/2009 Petite
2009/0229469 A1 9/2009 Campbell et al.
2009/0296832 A1 12/2009 Hunt
2009/0324428 A1 12/2009 Tolbert, Jr. et al.
2010/0006042 A1 1/2010 Pitonyak et al.
2010/0011962 A1 1/2010 Totsugi
2010/0017465 A1 1/2010 Brownrigg et al.
2010/0039984 A1 2/2010 Brownrigg
2010/0044449 A1 2/2010 Tessier
2010/0070084 A1 3/2010 Steinberg et al.
2010/0070234 A1 3/2010 Steinberg et al.
2010/0070666 A1 3/2010 Brindle
2010/0078493 A1 4/2010 Alles
2010/0081357 A1 4/2010 Alles
2010/0081372 A1 4/2010 Alles
2010/0089076 A1 4/2010 Schuster et al.
2010/0102136 A1 4/2010 Hadzidedic et al.
2010/0111709 A1 5/2010 Jayanth
2010/0168924 A1 7/2010 Tessier et al.
2010/0169030 A1 7/2010 Parlos
2010/0179703 A1 7/2010 Singh et al.
2010/0191487 A1 7/2010 Rada et al.
2010/0194582 A1 8/2010 Petite
2010/0214709 A1 8/2010 Hall et al.
2010/0217550 A1 8/2010 Crabtree et al.
2010/0250054 A1 9/2010 Petite
2010/0257410 A1 10/2010 Cottrell et al.
2010/0262299 A1 10/2010 Cheung et al.
2010/0265909 A1 10/2010 Petite et al.
2010/0280667 A1 11/2010 Steinberg

(56) References Cited

U.S. PATENT DOCUMENTS

| | | | |
|---|---|---|---|
| 2010/0282857 | A1 | 11/2010 | Steinberg |
| 2010/0287489 | A1 | 11/2010 | Alles |
| 2010/0305718 | A1 | 12/2010 | Clark et al. |
| 2010/0308119 | A1 | 12/2010 | Steinberg et al. |
| 2010/0312881 | A1 | 12/2010 | Davis et al. |
| 2010/0318227 | A1 | 12/2010 | Steinberg et al. |
| 2010/0330985 | A1 | 12/2010 | Addy |
| 2011/0004350 | A1 | 1/2011 | Cheifetz et al. |
| 2011/0022429 | A1 | 1/2011 | Yates et al. |
| 2011/0023045 | A1 | 1/2011 | Yates et al. |
| 2011/0023945 | A1 | 2/2011 | Hayashi et al. |
| 2011/0040785 | A1 | 2/2011 | Steenberg et al. |
| 2011/0042541 | A1 | 2/2011 | Spencer et al. |
| 2011/0045454 | A1 | 2/2011 | McManus et al. |
| 2011/0054842 | A1 | 3/2011 | Kates |
| 2011/0071960 | A1 | 3/2011 | Singh |
| 2011/0077896 | A1 | 3/2011 | Steinberg et al. |
| 2011/0083450 | A1 | 4/2011 | Turner et al. |
| 2011/0102159 | A1 | 5/2011 | Olson et al. |
| 2011/0103460 | A1 | 5/2011 | Bonicatto |
| 2011/0106471 | A1 | 5/2011 | Curtis et al. |
| 2011/0112814 | A1 | 5/2011 | Clark |
| 2011/0118905 | A1 | 5/2011 | Mylaraswamy et al. |
| 2011/0121952 | A1 | 5/2011 | Bonicatto et al. |
| 2011/0144932 | A1 | 6/2011 | Alles |
| 2011/0144944 | A1 | 6/2011 | Pham |
| 2011/0166828 | A1 | 7/2011 | Steinberg et al. |
| 2011/0181438 | A1 | 7/2011 | Millstein et al. |
| 2011/0184563 | A1 | 7/2011 | Foslien et al. |
| 2011/0185895 | A1 | 8/2011 | Freen |
| 2011/0190910 | A1 | 8/2011 | Lombard et al. |
| 2011/0212700 | A1 | 9/2011 | Petite |
| 2011/0218957 | A1 | 9/2011 | Coon et al. |
| 2011/0264324 | A1 | 10/2011 | Petite et al. |
| 2011/0264409 | A1 | 10/2011 | Jayanth et al. |
| 2011/0290893 | A1 | 12/2011 | Steinberg |
| 2011/0307103 | A1 | 12/2011 | Cheung et al. |
| 2011/0309953 | A1 | 12/2011 | Petite et al. |
| 2011/0310929 | A1 | 12/2011 | Petite et al. |
| 2011/0315019 | A1 | 12/2011 | Lyon et al. |
| 2011/0320050 | A1 | 12/2011 | Petite et al. |
| 2012/0005590 | A1 | 1/2012 | Lombard et al. |
| 2012/0054242 | A1 | 3/2012 | Ferrara et al. |
| 2012/0065783 | A1 | 3/2012 | Fadell et al. |
| 2012/0065935 | A1 | 3/2012 | Steinberg et al. |
| 2012/0066168 | A1 | 3/2012 | Fadell et al. |
| 2012/0075092 | A1 | 3/2012 | Petite et al. |
| 2012/0092154 | A1 | 4/2012 | Petite |
| 2012/0125559 | A1 | 5/2012 | Fadell et al. |
| 2012/0125592 | A1 | 5/2012 | Fadell et al. |
| 2012/0126019 | A1 | 5/2012 | Warren et al. |
| 2012/0126020 | A1 | 5/2012 | Filson et al. |
| 2012/0126021 | A1 | 5/2012 | Warren et al. |
| 2012/0128025 | A1 | 5/2012 | Huppi et al. |
| 2012/0130546 | A1 | 5/2012 | Matas et al. |
| 2012/0130547 | A1 | 5/2012 | Fadell et al. |
| 2012/0130548 | A1 | 5/2012 | Fadell et al. |
| 2012/0130679 | A1 | 5/2012 | Fadell et al. |
| 2012/0131504 | A1 | 5/2012 | Fadell et al. |
| 2012/0143528 | A1 | 6/2012 | Kates |
| 2012/0179300 | A1 | 7/2012 | Warren et al. |
| 2012/0186774 | A1 | 7/2012 | Matsuoka et al. |
| 2012/0191257 | A1 | 7/2012 | Corcoran et al. |
| 2012/0199660 | A1 | 8/2012 | Warren et al. |
| 2012/0203379 | A1 | 8/2012 | Sloo et al. |
| 2012/0221150 | A1 | 8/2012 | Arensmeier |
| 2012/0229521 | A1 | 9/2012 | Hales, IV et al. |
| 2012/0232969 | A1 | 9/2012 | Fadell et al. |
| 2012/0233478 | A1 | 9/2012 | Mucignat et al. |
| 2012/0239207 | A1 | 9/2012 | Fadell et al. |
| 2012/0239221 | A1 | 9/2012 | Mighdoll et al. |
| 2012/0245968 | A1 | 9/2012 | Beaulieu et al. |
| 2012/0248210 | A1 | 10/2012 | Warren et al. |
| 2012/0248211 | A1 | 10/2012 | Warren et al. |
| 2012/0260804 | A1 | 10/2012 | Kates |
| 2012/0265491 | A1 | 10/2012 | Drummy |
| 2012/0265586 | A1 | 10/2012 | Mammone |
| 2012/0271673 | A1 | 10/2012 | Riley |
| 2012/0291629 | A1 | 11/2012 | Tylutki et al. |
| 2012/0318135 | A1 | 12/2012 | Hoglund et al. |
| 2012/0318137 | A1 | 12/2012 | Ragland et al. |
| 2013/0066479 | A1 | 3/2013 | Shetty et al. |
| 2013/0156607 | A1 | 6/2013 | Jayanth |
| 2013/0166231 | A1 | 6/2013 | Jayanth et al. |
| 2013/0174588 | A1 | 7/2013 | Pham |
| 2013/0176649 | A1 | 7/2013 | Wallis et al. |
| 2013/0287063 | A1 | 10/2013 | Kates |
| 2013/0294933 | A1 | 11/2013 | Pham |
| 2014/0000290 | A1 | 1/2014 | Kates |
| 2014/0000291 | A1 | 1/2014 | Kates |
| 2014/0000292 | A1 | 1/2014 | Kates |
| 2014/0000293 | A1 | 1/2014 | Kates |
| 2014/0000294 | A1 | 1/2014 | Kates |
| 2014/0012422 | A1 | 1/2014 | Kates |
| 2014/0069121 | A1 | 3/2014 | Pham |
| 2014/0074730 | A1 | 3/2014 | Arensmeier et al. |
| 2014/0084836 | A1 | 3/2014 | Pham et al. |
| 2014/0229014 | A1 | 8/2014 | Pham et al. |
| 2014/0260342 | A1 | 9/2014 | Pham |
| 2014/0260390 | A1 | 9/2014 | Pham |
| 2014/0262134 | A1 | 9/2014 | Arensmeier et al. |
| 2014/0266755 | A1 | 9/2014 | Arensmeier et al. |
| 2014/0297208 | A1 | 10/2014 | Arensmeier |
| 2014/0299289 | A1 | 10/2014 | Alsaleem et al. |
| 2015/0135748 | A1 | 5/2015 | Alsaleem et al. |
| 2015/0155701 | A1 | 6/2015 | Wallis et al. |
| 2015/0261230 | A1 | 9/2015 | Kates |
| 2015/0367463 | A1 | 12/2015 | Pham |
| 2016/0076536 | A1 | 3/2016 | Jayanth et al. |
| 2016/0223238 | A1 | 8/2016 | Kates |
| 2016/0226416 | A1 | 8/2016 | Pham et al. |

FOREIGN PATENT DOCUMENTS

| | | | |
|---|---|---|---|
| CA | 2528778 | A1 | 12/2004 |
| CA | 2567264 | A1 | 7/2007 |
| CH | 173493 | A | 11/1934 |
| CN | 1169619 | A | 1/1998 |
| CN | 1742427 | A | 3/2006 |
| CN | 1922445 | A | 2/2007 |
| CN | 101048713 | A | 10/2007 |
| CN | 101048713 | A | 10/2007 |
| CN | 101156033 | A | 4/2008 |
| CN | 101156033 | A | 4/2008 |
| CN | 101270908 | A | 9/2008 |
| CN | 101361244 | A | 2/2009 |
| CN | 101466193 | A | 6/2009 |
| CN | 101466193 | A | 6/2009 |
| CN | 101506600 | A | 8/2009 |
| CN | 101506600 | A | 8/2009 |
| CN | 101802521 | A | 8/2010 |
| CN | 101802521 | A | 8/2010 |
| CN | 101821693 | A | 9/2010 |
| DE | 842351 | C | 6/1952 |
| DE | 764179 | C | 4/1953 |
| DE | 1144461 | B | 2/1963 |
| DE | 1403516 | A1 | 10/1968 |
| DE | 3133502 | A1 | 6/1982 |
| DE | 3508353 | A1 | 9/1985 |
| DE | 3508353 | A1 | 9/1985 |
| DE | 3422398 | A1 | 12/1985 |
| EP | 0124603 | A1 | 11/1984 |
| EP | 0254253 | A2 | 1/1988 |
| EP | 0346152 | A2 | 12/1989 |
| EP | 0351833 | A2 | 1/1990 |
| EP | 0410330 | A2 | 1/1991 |
| EP | 0419857 | A2 | 4/1991 |
| EP | 0479421 | A1 | 4/1992 |
| EP | 0557023 | A1 | 8/1993 |
| EP | 0579374 | A1 | 1/1994 |
| EP | 0660213 | A2 | 6/1995 |
| EP | 0747598 | A2 | 12/1996 |
| EP | 0982497 | A1 | 3/2000 |
| EP | 1008816 | A2 | 6/2000 |

(56) References Cited

FOREIGN PATENT DOCUMENTS

| | | | |
|---|---|---|---|
| EP | 1087142 | A2 | 3/2001 |
| EP | 1138949 | A2 | 10/2001 |
| EP | 1139037 | A1 | 10/2001 |
| EP | 1187021 | A2 | 3/2002 |
| EP | 1209427 | A1 | 5/2002 |
| EP | 1393034 | A1 | 3/2004 |
| EP | 1435002 | A1 | 7/2004 |
| EP | 1487077 | A2 | 12/2004 |
| EP | 1541869 | A1 | 6/2005 |
| EP | 1541869 | A1 | 6/2005 |
| EP | 2180270 | A1 | 4/2010 |
| FR | 2582430 | A1 | 11/1986 |
| FR | 2589561 | A1 | 5/1987 |
| FR | 2628558 | A1 | 9/1989 |
| FR | 2660739 | A1 | 10/1991 |
| GB | 2064818 | A | 6/1981 |
| GB | 2116635 | A | 9/1983 |
| GB | 2229295 | A | 9/1990 |
| GB | 2347217 | A | 8/2000 |
| GB | 2347217 | A | 8/2000 |
| JP | 56010639 | A | 2/1981 |
| JP | 59145392 | A | 8/1984 |
| JP | 61046485 | A | 3/1986 |
| JP | 62116844 | A | 5/1987 |
| JP | 63302238 | A | 12/1988 |
| JP | 01014554 | A | 1/1989 |
| JP | 04080578 | A | 3/1992 |
| JP | 08087229 | A | 4/1996 |
| JP | 08284842 | A | 10/1996 |
| JP | H08261541 | A | 10/1996 |
| JP | 2003018883 | A | 1/2003 |
| JP | 2005241089 | A | 9/2005 |
| JP | 2005345096 | A | 12/2005 |
| JP | 2006274807 | A | 10/2006 |
| JP | 2009002651 | A | 1/2009 |
| JP | 2009229184 | A | 10/2009 |
| JP | 2009229184 | A | 10/2009 |
| JP | 2010048433 | A | 3/2010 |
| KR | 10-1998-0036844 | A | 8/1998 |
| KR | 20000000261 | A | 1/2000 |
| KR | 20030042857 | A | 6/2003 |
| KR | 20030042857 | A | 6/2003 |
| RU | 30009 | U1 | 6/2003 |
| RU | 30009 | U1 | 6/2003 |
| RU | 55218 | U1 | 7/2006 |
| RU | 55218 | U1 | 7/2006 |
| WO | WO-8601262 | A1 | 2/1986 |
| WO | WO-8703988 | A1 | 7/1987 |
| WO | WO-8705097 | A1 | 8/1987 |
| WO | WO-8802527 | A1 | 4/1988 |
| WO | WO-9748161 | A1 | 12/1997 |
| WO | WO-0021047 | A1 | 4/2000 |
| WO | WO-0214968 | A1 | 2/2002 |
| WO | WO-02/090840 | A2 | 11/2002 |
| WO | WO-02/090913 | A1 | 11/2002 |
| WO | WO-02090914 | A1 | 11/2002 |
| WO | WO-03031996 | A1 | 4/2003 |
| WO | WO-03090000 | A1 | 10/2003 |
| WO | WO-2004049088 | A1 | 6/2004 |
| WO | WO-2005022049 | A2 | 3/2005 |
| WO | WO-2005073686 | A1 | 8/2005 |
| WO | WO-2005108882 | A2 | 11/2005 |
| WO | WO-2006023075 | A2 | 3/2006 |
| WO | WO-2006025880 | A1 | 3/2006 |
| WO | WO-2006091521 | A2 | 8/2006 |
| WO | WO-2008010988 | A1 | 1/2008 |
| WO | 2008079108 | A1 | 7/2008 |
| WO | WO-2008079108 | A1 | 7/2008 |
| WO | WO-2008144864 | A1 | 12/2008 |
| WO | WO-2010138831 | A2 | 12/2010 |
| WO | WO-2011069170 | A1 | 6/2011 |
| WO | WO-2012092625 | A2 | 7/2012 |
| WO | WO-2012118550 | A1 | 9/2012 |

OTHER PUBLICATIONS

"Manual for Freezing and Air Conditioning Technology," Fan Jili, Liaoning Science and Technology Press, Sep. 1995 (cited in First Office Action issued by the Chinese Patent Office regarding Application No. 200780030810.X dated Dec. 25, 2009).

"Small-type Freezing and Air Conditioning Operation," Chinese State Economy and Trading Committee, China Meteorological Press, Mar. 2002 (cited in First Office Action issued by the Chinese Patent Office regarding Application No. 200780030810.X dated Dec. 25, 2009).

First Office Action issued by the Chinese Patent Office regarding Application No. 200780030810.X dated Dec. 25, 2009.

International Search Report for International Application No. PCT/US2007/016135 dated Oct. 22, 2007.

International Search Report for International Application No. PCT/US2008/009618, dated Dec. 8, 2008.

Written Opinion of International Searching Authority for International Application No. PCT/US2008/009618, dated Dec. 8, 2008.

International Preliminary Report on Patentability for International Application No. PCT/US2008/009618, dated Apr. 1, 2010.

First Office Action regarding Chinese Application No. 200880106319.5, dated May 25, 2011. English translation provided by Unitalen Attorneys at Law.

Notice of Grounds for Refusal regarding Korean Patent Application No. 10-2009-7000850, mailed Oct. 4, 2013. English translation provided by Y.S. Chang & Associates.

International Search Report regarding Application No. PCT/US2014/028074, dated Jun. 19, 2014.

Written Opinion of the International Searching Authority regarding Application No. PCT/US2014/028074, dated Jun. 19, 2014.

Invitation to Indicate Claims to be Searched regarding European Patent Application No. 07 796 879.0, dated Feb. 20, 2013.

Written Opinion of the International Searching Authority regarding Application No. PCT/US2007/016135, mailed Oct. 22, 2007.

About CABA: CABA eBulletin, http://www.caba.org/aboutus/ebulletin/issue17/domosys.html, 2 pages.

Case Studies: Automated Meter Reading and Load Shed System, http://groupalpha.corn/CaseStudies2.html, Aug. 23, 2004, 1 page.

European Search Report for EP 01 30 7547; Feb. 20, 2002; 1 Page.

European Search Report for EP 02 25 0266; May 17, 2002; 3 Pages.

European Search Report for EP 02 72 9050, Jun. 17, 2004, 2 pages.

European Search Report for EP 82306809.3; Apr. 28, 1983; 1 Page.

European Search Report for EP 91 30 3518; Jul. 22, 1991; 1 Page.

European Search Report for EP 93 30 4470; Oct. 26, 1993; 1 Page.

European Search Report for EP 94 30 3484; Apr. 3, 1997; 1 Page.

European Search Report for EP 96 30 4219; Dec. 1, 1998; 2 Pages.

European Search Report for EP 98 30 3525; May 28, 1999; 2 Pages.

European Search Report for EP 99 30 6052; Dec. 28, 1999; 3 Pages.

Examiner-Initiated Interview Summary regarding U.S. Appl. No. 11/214,179, dated Dec. 11, 2009.

Extended European Search Report regarding Application No. 07796879.0-1602 / 2041501 PCT/US2007016135, dated Jul. 14, 2014.

Extended European Search Report regarding European Application No. 08848538.8-1608 / 2220372, dated Jun. 19, 2015.

Final Office Action and Interview Summary regarding U.S. Appl. No. 13/407,180, mailed Mar. 13, 2015.

First Office Action regarding Canadian Patent Application No. 2,777,349, dated Jul. 19, 2013.

Haiad et al., "EER & SEER As Predictors of Seasonal Energy Performance", Oct. 2004, Southern California Edison, http://www.doe2.com/download/DEER/SEER%2BProgThermostats/EER-SEER_CASE_ProjectSummary_Oct2004_V6a.pdf.

Home Comfort Zones, MyTemp Room-by-Room Zone Control, Nov. 2009.

Home Comfort Zones, MyTemp User Manual v4.3, May 2008.

Home Comfort Zones, Save Energy with MyTemp™ Zone Control, Dec. 2009.

Home Comfort Zones, Smart Controller™ MyTemp™ Room by Room Temperature Control and Energy Management, User Manual, Aug. 2007.

(56) References Cited

OTHER PUBLICATIONS

Honeywell, A7075A1000 HVAC Service Assistant, 2001.
Honeywell, Advanced Portable A/C Diagnostics, The HVAC Service Assistant, 2003.
Honeywell, Alerts and Delta T Diagnostics with Prestige® 2.0 IAQ Thermostat, 69-2678-02, Sep. 2011.
Honeywell, Excel 5000® System, Excel Building Supervisor—Integrated, 74-2034, Copyright © 1994, Rev. Nov. 1994, 12 pages.
Honeywell, Excel 5000® System, Excel Building Supervisor, 74-2033-1, Copyright © 1996, Rev. Jun. 1996, 12 pages.
Honeywell, HVAC Service Assistant, TRGpro PalmTM OS Interface and HVAC Service Assistant A7075A1000, 2002.
Honeywell, Prestige System Installation Guide, THX9321/9421 Prestige® IAQ and RF EIM, 64-2490-03, Jul. 2011.
Honeywell, RedLINK™ Wireless Comfort Systems brochure, 50-1194, Sep. 2011.
HVAC Service Assistant, ACRx Efficiency and Capacity Estimating Technology, Field Diagnostics, 2004.
International Preliminary Examination Report regarding PCT/US02/13456, dated Sep. 15, 2003.
International Preliminary Report on Patentability regarding Application No. PCT/US2010/056315, mailed May 24, 2012.
International Search Report and Written Opinion for related PCT Application No. PCT/US2014/028859, dated Aug. 22, 2014.
International Search Report and Written Opinion of the International Searching Authority regarding International Application No. PCT/US06/33702, dated Sep. 26, 2007.
International Search Report and Written Opinion of the ISA regarding International Application No. PCT/US2014/032927, ISA/KR dated Aug. 21, 2014.
International Search Report for International Application No. PCT/US07/019563, dated Jan. 15, 2008, 3 Pages.
International Search Report for PCT/US02/13459; ISA/US; date mailed Sep. 19, 2002.
International Search Report for PCT/US2012/026973, Sep. 3, 2012, 5 pages.
International Search Report for PCT/US2013/061389, Jan. 22, 2014, 7 pages.
International Search Report from PCT /US2008/060900, Aug. 4, 2008, 6 pages.
International Search Report regarding Application No. PCT/US2010/036601, mailed Dec. 29, 2010.
International Search Report regarding Application No. PCT/US2010/056315, mailed Jun. 28, 2011.
International Search Report, Int'l. App. No. PCT/US 06/05917, dated Sep. 26, 2007.
International Search Report, International Application No. PCT/US02/13456, dated Aug. 22, 2002, 2 Pages.
International Search Report, International Application No. PCT/US04/13384; Dated Aug. 1, 2004; 1 Page.
International Search Report, International Application No. PCT/US2004/027654, dated Aug. 25, 2004, 4 Pages.
International Search Report; International Application No. PCT/IB96/01435; May 23, 1997; 1 Page.
International Search Report; International Application No. PCT/US98/18710; Jan. 26, 1999; 1 Page.
Palani, M. et al, The Effect of Reducted Evaporator Air Flow on the Performance of a Residential Central Air Conditioner, ESL-HH-92-05-04, Energy Systems Laboratory, Mechanical Engineering Department, Texas A&M University, Eighth Symposium on Improving Building System in Hot and Humid Climates, May 13-14, 1992.
Search Report regarding European Patent Application No. 08251185.8-1605 / 2040016, dated Dec. 4, 2015.
Supplementary European Search Report for EP 02 73 1544, Jun. 18, 2004, 2 Pages.
Texas Instruments, Inc. Mechanical Data for "PT (S-PQFP-G48) Plastic Quad Flatpack," Revised Dec. 1996, 2 pages.
The LS2000 Energy Management System, User Guide, http://www.surfnetworks.com/htmlmanuals/IonWorksEnergyManagement-LS2000-Load-Shed-System-by-Surf-Networks,Inc.html, Sep. 2004, 20 pages.
Trane EarthWise™ CenTra Vac™ Water-Cooled Liquid Chillers 165-3950 Tons 50 and 60 Hz; CTV PRC007-EN; Oct. 2002; 56 pages.
Udelhoven, Darrell, "Air Conditioning System Sizing for Optimal Efficiency," http://www.udarrell.com/ airconditioning-sizing.html, Oct. 6, 2003, 7 pages.
Udelhoven, Darrell, "Optimizing Air Conditioning Efficiency TuneUp Optimizing the Condenser Output, Seer, Air, HVAC Industry," http://www.udarrell.com/air-conditioning-efficiency.html, Jul. 19, 2002, 13 pages.
UltraSite User's Guide, Computer Process Controls, Apr. 1, 1996.
Vandenbrink et al.,"Design of a Refrigeration Cycle Evaporator Unit," Apr. 18, 2003.
Watt, James; Development of Empirical Temperature and Humidity-Based Degraded-Condition Indicators for Low-Tonnage Air Conditioners; ESL-TH-97/12-03; Dec. 1997.
Written Opinion of the International Searching Authority regarding Application No. PCT/US2010/036601, mailed Dec. 29, 2010.
Written Opinion of the International Searching Authority regarding Application No. PCT/US2012/026973, dated Sep. 3, 2012.
Written Opinion of the International Searching Authority regarding Application No. PCT/US2013/061389, mailed Jan. 22, 2014.
Written Opinion of the International Searching Authority, Int'l. App. No. PCT/US 06/05917, dated Sep. 26, 2007.
Written Opinion regarding PCT/US02/13459, dated Apr. 23, 2003.
"Air Conditioning Equipment and Diagnostic Primer," Field Diagnostic Services, Inc., Sep. 9, 2002.
About CABA: CABA eBulletin, http://www.caba.org/aboutus/ebulletin/issue17/domosys.html. 2 pages.
Advanced Utility Metering: Period of Performance, Subcontractor Report, National Renewable Energy Laboratory, Sep. 2003, 59 pages.
Advisory Action and Interview Summary regarding U.S. Appl. No. 13/407,180, dated May 27, 2015.
Advisory Action regarding U.S. Appl. No. 13/269,188, dated Apr. 13, 2015.
Advisory Action regarding U.S. Appl. No. 11/214,179, dated Aug. 28, 2009.
Applicant-Initiated Interview Summary and Advisory Action regarding U.S. Appl. No. 13/369,067, dated Jul. 23, 2015.
Applicant-Initiated Interview Summary regarding U.S. Appl. No. 14/212,632, dated Sep. 2, 2015.
Case Studies: Automated Meter Reading and Load Shed System, http://groupalpha.com/CaseStudies2.html, Aug. 23, 2004, 1 page.
Communication from European Patent Office concerning Substantive Examination regarding European Patent Application No. 06790063.9, dated Jun. 6, 2011.
Cost Cutting Techniques Used by the Unscrupulous, http://www.kellyshvac.com/howto.html, Oct. 7, 2004, 3 pages.
European Search Report for EP 01 30 7547; dated Feb. 20, 2002; 1 Page.
European Search Report for EP 02 25 0266; dated May 17, 2002; 3 Pages.
European Search Report for EP 02 72 9050, dated Jun. 17, 2004; 2 pages.
European Search Report for EP 82306809.3; dated Apr. 28, 1983; 1 Page.
European Search Report for EP 91 30 3518; dated Jul. 22, 1991; 1 Page.
European Search Report for EP 93 30 4470; dated Oct. 26, 1993; 1 Page.
European Search Report for EP 94 30 3484; dated Apr. 3, 1997; 1 Page.
European Search Report for EP 96 30 4219; dated Dec. 1, 1998; 2 Pages.
European Search Report for EP 98 30 3525; dated May 28, 1999; 2 Pages.
European Search Report for EP 99 30 6052; dated Dec. 28, 1999; 3 Pages.

(56) References Cited

OTHER PUBLICATIONS

European Search Report regarding Application No. EP02729051, dated Feb. 17, 2005.
Examination Report received from Australian Government IP Australia dated Oct. 29, 2009 regarding patent application No. 2008202088.
Examiner Interview regarding U.S. Appl. No. 11/256,641, dated Sep. 16, 2008.
Examiner Interview Summary regarding U.S. Appl. No. 11/394,380, dated Jul. 29, 2010.
Examiner Interview Summary regarding U.S. Appl. No. 10/940,877, dated Dec. 8, 2008.
Examiner Interview Summary regarding U.S. Appl. No. 10/940,877, dated Mar. 2, 2007.
Examiner Interview Summary regarding U.S. Appl. No. 10/940,877, dated Mar. 25, 2008.
Examiner's First Report on Australian Patent Application No. 2002259066, dated Mar. 1, 2006.
Examiner's Report No. 1 regarding Australian Patent Application No. 2013202431, dated Nov. 25, 2014.
Examiner-Initiated Interview Summary regarding U.S. App. No. 11/214,179, dated Dec. 11, 2009.
Extended European Search Report regarding Application No. 07796879.0-1602/2041501 PCT/US2007016135, dated Jul. 14, 2014.
Extended European Search Report regarding European Application No. 08845689.2-1608/2207964, dated Jun. 19, 2015.
Extended European Search Report regarding European Application No. 08848538.8-1608/2220372, dated Jun. 19, 2015.
Faramarzi et al., "Performance Evaluation of Rooftop Air Conditioning Units at High Ambient Temperatures," 2004 ACEEE Summer Study on Energy Efficiency in Buildings—http://aceee.org/files/proceedings/2004/data/papers/SSO4_Panel3_Paper05.pdf.
Final Office Action and Interview Summary regarding U.S. Appl. No. 13/407,180, dated Mar. 13, 2015.
Final Office Action for U.S. Appl. No. 13/770,123 dated Dec. 22, 2014.
Final Office Action from related U.S. Appl. No. 13/269,188 dated May 23, 2013; 11 pages.
Final Office Action from related U.S. Appl. No. 13/369,067 dated May 1, 2014; 19 pages.
Final Office Action from related U.S. Appl. No. 13/767,479 dated Mar. 14, 2014; 6 pages.
Final Office Action from related U.S. Appl. No. 13/836,043 dated Mar. 12, 2014; 5 pages.
Final Office Action regarding U.S. Appl. No. 11/497,579, dated May 14, 2010.
Final Office Action regarding U.S. Appl. No. 11/497,644, dated Dec. 22, 2010.
Final Office Action regarding U.S. Appl. No. 13/770,479, dated Sep. 4, 2015.
Final Office Action regarding U.S. Appl. No. 11/214,179, dated Jul. 21, 2011.
Final Office Action regarding U.S. Appl. No. 10/061,964, dated Mar. 8, 2004.
Final Office Action regarding U.S. Appl. No. 10/940,877, dated Nov. 13, 2007.
Final Office Action regarding U.S. Appl. No. 10/940,877, dated Apr. 27, 2009.
Final Office Action regarding U.S. Appl. No. 10/940,877, dated May 2, 2006.
Final Office Action regarding U.S. Appl. No. 11/214,179, dated May 29, 2009.
Final Office Action regarding U.S. Appl. No. 11/256,641, dated Feb. 2, 2009.
Final Office Action regarding U.S. Appl. No. 11/337,918, dated Feb. 17, 2011.
Final Office action regarding U.S. Appl. No. 11/337,918, dated Feb. 4, 2010.
First Chinese Office Action regarding Application No. 201380005300.2, dated Apr. 30, 2015. Translation provided by Unitalen Attorneys at Law.
First Examination Communication regarding European Application No. EP02729051.9, dated Dec. 23, 2005.
First Examination Report regarding Australian Patent Application No. 2010319488, dated Jan. 10, 2013.
First Office Action from the Patent Office of the People's Republic of China dated Jun. 8, 2007, Application No. 200480027753.6 and Translation provided by CCPIT.
First Office Action received from the Chinese Patent Office dated Feb. 2, 2007 regarding Application No. 200480011463.2, translated by CCPIT Patent and Trademark Law Office.
First Office Action regarding Canadian Patent Application No. 2,777,349. dated Jul. 19, 2013.
First Office Action regarding Chinese Patent Application No. 201280010796.8, dated Sep. 14, 2015. Translation provided by Unitalen Attorneys At Law.
First Official Report regarding Australian Patent Application No. 2007214381, dated Dec. 12, 2008.
Flow & Level Measurement: Mass Flowmeters, http://www.omega.com/literature/transactions/volume4/T9904-10-MASS.html, 2001, 19 pages.
Frequently Asked Questions, http://www.lipaedge.com/faq.asp, Copyright © 2001, 5 pages.
Haiad et al., "EER & SEER As Predictors of Seasonal Energy Performance ", Oct. 2004, Southern California Edison.
International Search Report, International Application No. PCT/US2006/040964, dated Feb. 15, 2007, 2 Pages.
International Search Report; International Application No. PCT/IB96/01435; dated May 23, 1997; 1 Page.
International Search Report; International Application No. PCT/US98/18710; dated Jan. 26, 1999; 1 Page.
Interview Summary from related U.S. Appl. No. 12/054,011 dated Jan. 30, 2012.
Interview Summary regarding U.S. Appl. No. 11/497,644, dated May 4, 2010.
Interview Summary regarding U.S. Appl. No. 13/269,188, dated Mar. 18, 2015.
Interview Summary regarding U.S. Appl. No. 13/369,067, dated Jul. 16. 2015.
Interview Summary regarding U.S. Appl. No. 13/407,180, dated Jun. 11, 2015.
Interview Summary regarding U.S. Appl. No. 13/770,479, dated Jun. 16, 2015.
Interview Summary regarding U.S. Appl. No. 13/770,479, dated Nov. 25, 2015.
Interview Summary regarding U.S. Appl. No. 11/214,179, dated Jan. 30, 2009.
Interview Summary regarding U.S. Appl. No. 11/497,579, dated Jul. 15, 2010.
Issue Notification regarding U.S. Appl. No. 11/214,179, dated Mar. 14, 2012.
Jeffus, Larry, "Refrigeration and Air Conditioning: An Introduction to HVAC/R," Appendix C, pp. 1060-1063, Copyright 2004.
Jeffus, Larry, "Refrigeration and Air Conditioning: An Introduction to HVAC/R," Section II, Chapter 4, pp. 176-201, Copyright 2004.
Jeffus, Larry, "Refrigeration and Air Conditioning: An Introduction to HVAC/R," Section II, Chapter 5, pp. 239-245, Copyright 2004.
Jeffus, Larry, "Refrigeration and Air Conditioning: An Introduction to HVAC/R," Section II, Chapter 6, p. 322, Copyright 2004.
Jeffus, Larry, "Refrigeration and Air Conditioning: An Introduction to HVAC/R," Section IV, Chapter 9, pp. 494-504, Copyright 2004.
K. A. Manske et al.; Evaporative Condenser Control in Industrial Refrigeration Systems; University of Wisconsin—Madison, Mechanical Engineering Department; International Journal of Refrigeration, vol. 24, No. 7; pp. 676-691; 2001, 21 pages.
Li et al., "Development, Evaluation, and Demonstration of a Virtual Refrigerant Charge Sensor," Jan. 2009, HVAC&R Research, Oct. 27, 2008, 21 pages.
Liao et al., A Correlation of Optimal Heat Rejection Pressures in Transcritical Carbon Dioxide Cycles, Applied Thermal Engineering 20 (2000), Jul. 25, 1999, 831-841.

(56) References Cited

OTHER PUBLICATIONS

LIPA Launches Free, First-in-Nation Internet-Based Air Conditioner Control Program to Help LIPA and Its Customers Conserve Electricity & Save Money, Apr. 19, 2001, http://www.lipower.org/newscmter/pr/2001/aprill9_01.html, 3 pages.
Low-Cost Multi-Service Home Gateway Creates New Business Opportunities, Coactive Networks, Copyright 1998-1999, 7 pages.
Nickles, Donald, "Broadband Communications Over Power Transmission Lines," A Guest Lecture From the Dr. Shreekanth Mandaynam Engineering Frontiers Lecture Series, May 5, 2004, 21 pages.
Non Final Office Action for U.S. Appl. No. 13/407,180, dated Dec. 2, 2014.
Non Final Office Action for related U.S. Appl. No. 13/369,067 dated Aug. 12, 2014.
Non Final Office Action for related U.S. Appl. No. 13/835,621 dated Aug. 8, 2014.
Non Final Office Action from related U.S. Appl. No. 13/269,188 dated Aug. 14, 2012; 9 pages.
Non Final Office Action from related U.S. Appl. No. 13/269,188 dated Oct. 4, 2013; 11 pages.
Non Final Office Action from related U.S. Appl. No. 13/269,188 dated Feb. 20, 2014; 9 pages.
Non Final Office Action from related U.S. Appl. No. 13/269,188 dated Jul. 17, 2014; 10 pages.
Non Final Office Action from related U.S. Appl. No. 13/369,067 dated Jan. 16, 2014; 16 pages.
Non Final Office Action from related U.S. Appl. No. 13/767,479 dated Oct. 24, 2013; 8 pages.
Non Final Office Action from related U.S. Appl. No. 13/767,479 dated Jul. 23, 2014; 9 pages.
Non Final Office Action from related U.S. Appl. No. 13/835,621 dated Oct. 30, 2013; 8 pages.
Non Final Office Action from related U.S. Appl. No. 13/835,621 dated Apr. 2, 2014; 11 pages.
Non Final Office Action from related U.S. Appl. No. 13/835,742 dated Oct. 7, 2013; 9 pages.
Non Final Office Action from related U.S. Appl. No. 13/835,810 dated Nov. 15, 2013; 9 pages.
Non Final Office Action from related U.S. Appl. No. 13/836,043 dated Oct. 23, 2013; 8 pages.
Non Final Office Action from related U.S. Appl. No. 13/836,043 dated Jul. 11, 2014; 5 pages.
Non Final Office Action from related U.S. Appl. No. 13/836,244 dated Oct. 15, 2013; 11 pages.
Non Final Office Action from related U.S. Appl. No. 13/836,244 dated Feb. 20, 2014; 10 pages.
Non Final Office Action from related U.S. Appl. No. 13/836,453 dated Aug. 20, 2013; 8 pages.
Non-Final Office Action in U.S. Appl. No. 13/784,890, dated Jun. 11, 2013.
Non-Final Office Action regarding U.S. Appl. No. 11/214,179, dated Jan. 24, 2011.
Non-Final Office Action regarding U.S. Appl. No. 11/214,179, dated Nov. 5, 2008.
Non-Final Office Action regarding U.S. Appl. No. 11/214,179, dated Jun. 8, 2010.
Non-Final Office Action regarding U.S. Appl. No. 12/261,643, dated Mar. 12, 2013.
Non-Final Office Action regarding U.S. Appl. No. 12/943,626, dated Dec. 20, 2012.
Non-Final Office Action regarding U.S. Appl. No. 12/955,355, dated Sep. 11, 2012.
Non-Final Office Action regarding U.S. Appl. No. 13/435,543, dated Jun. 21, 2012.
Non-Final Office Action regarding U.S. Appl. No. 13/770,123, dated Jun. 11, 2014.
Non-Final Office Action regarding U.S. Appl. No. 13/932,611, dated Jan. 30, 2015.
Notice of Allowance and Fee(s) Due regarding U.S. Appl. No. 12/789,562, dated Oct. 26, 2012.
Notice of Allowance and Fees Due and Notice of Allowability regarding U.S. Appl. No. 11/256,641, dated May 19, 2009.
Notice of Allowance and Fees Due regarding U.S. Appl. No. 12/261,643, dated Jun. 23, 2014.
Notice of Allowance and Fees Due regarding U.S. Appl. No. 12/943,626, dated Jun. 19, 2014.
Notice of Allowance and Fees Due regarding U.S. Appl. No. 13/737,566, dated Jun. 18, 2014.
Notice of Allowance and Fees Due regarding U.S. Appl. No. 13/737,566, dated Sep. 24, 2014.
Notice of Allowance and Fees Due, Interview Summary and Notice of Allowability regarding U.S. Appl. No. 11/214,179, dated Nov. 23, 2011.
Notice of Allowance and Interview Summary regarding U.S. Appl. No. 13/269,188, dated Aug. 26, 2015.
Notice of Allowance and Notice of Allowability regarding U.S. Appl. No. 10/286,419, dated Dec. 2, 2004.
Notice of Allowance and Notice of Allowability regarding U.S. Appl. No. 10/675,137, dated Dec. 16, 2005.
Notice of Allowance dated Dec. 21, 2007 from Related U.S. Appl. No. 11/417,609.
Notice of Allowance dated Dec. 3, 2007 from Related U.S. Appl. No. 11/130,562.
Notice of Allowance dated Feb. 12, 2007 from Related U.S. Appl. No. 11/130,871.
Notice of Allowance dated Jul. 13, 2006 from Related U.S. Appl. No. 11/130,601.
Notice of Allowance dated Jul. 25, 2007 from Related U.S. Appl. No. 10/916,223.
Notice of Allowance dated Jun. 11, 2007 from Related U.S. Appl. No. 10/916,222.
Notice of Allowance dated May 29, 2007 from Related U.S. Appl. No. 11/130,569.
Notice of Allowance dated Nov. 3, 2008 from Related U.S. Appl. No. 11/417,701.
Notice of Allowance dated Oct. 26, 2007 from Related U.S. Appl. No. 10/916,223.
Notice of Allowance for U.S. Appl. No. 13/835,742 dated Dec. 24, 2014.
Notice of Allowance for U.S. Appl. No. 13/835,810 dated Jan. 2, 2015.
Notice of Allowance for U.S. Appl. No. 13/836,043 dated Feb. 4, 2015.
Notice of Allowance for U.S. Appl. No. 13/836,453 dated Dec. 24, 2014.
Notice of Allowance for related U.S. Appl. No. 13/835,810 dated Aug. 5, 2014.
Notice of Allowance for related U.S. Appl. No. 13/836,043, dated Oct. 9, 2014.
Notice of Allowance for related U.S. Appl. No. 13/836,244, dated Oct. 30, 2014.
Notice of Allowance for U.S. Appl. No. 10/698,048, dated Sep. 1, 2005.
Notice of Allowance from related U.S. Appl. No. 13/835,742 dated Jan. 31, 2014; 7 pages.
Notice of Allowance from related U.S. Appl. No. 13/835,742 dated Jun. 2, 2014; 8 pages.
Notice of Allowance from related U.S. Appl. No. 13/835,810 dated Mar. 20, 2014; 9 pages.
Notice of Allowance from related U.S. Appl. No. 13/836,453 dated Jan. 14, 2014; 8 pages.
Notice of Allowance from related U.S. Appl. No. 13/836,453 dated Apr. 21, 2014; 8 pages.
Notice of Allowance from related U.S. Appl. No. 13/836,453 dated Aug. 4, 2014.
Notice of Allowance from related U.S. Appl. No. 13/836,244 dated Jul. 2, 2014; 8 pages.
Notice of Allowance regarding U.S. Appl. No. 13/767,479, dated Mar. 31, 2015.
Notice of Allowance regarding U.S. Appl. No. 13/770,123, dated Oct. 1, 2015.

(56) References Cited

OTHER PUBLICATIONS

Notice of Allowance regarding U.S. Appl. No. 13/835,621, dated Mar. 10, 2015.
Notice of Allowance regarding U.S. Appl. No. 12/261,643, dated Jul. 29, 2015.
Notice of Allowance regarding U.S. Appl. No. 13/369,067, dated Sep. 2, 2015.
Notice of Allowance regarding U.S. Appl. No. 13/407,180, dated Sep. 4, 2015.
Notice of Allowance regarding U.S. Appl. No. 13/770,123, dated Aug. 13, 2015.
Notice of Allowance regarding U.S. Appl. No. 13/835,742, dated Apr. 17, 2015.
Notice of Allowance regarding U.S. Appl. No. 13/836,453, dated Apr. 15, 2015.
Notice of Allowance regarding U.S. Appl. No. 13/932,611, dated Jul. 6, 2015.
Notice of Allowance regarding U.S. Appl. No. 10/061,964, dated Jul. 19, 2004.
Notice of Allowance regarding U.S. Appl. No. 10/940,877, dated Sep. 4, 2009.
Notice of Allowance regarding U.S. Appl. No. 12/685,424, dated Apr. 25, 2011.
Notice of Allowance regarding U.S. Appl. No. 13/303,286, dated Jul. 19, 2012.
Office Action and Interview Summary regarding U.S. Appl. No. 14/244,967, dated Oct. 7, 2015.
Office Action dated Apr. 19, 2006 from Related U.S. Appl. No. 10/916,223.
Office Action dated Aug. 17, 2007 from Related U.S. Appl. No. 11/417,609.
Office Action dated Aug. 17, 2007 from Related U.S. Appl. No. 11/417,701.
Office Action dated Aug. 21, 2007 from Related U.S. Appl. No. 11/417,557.
Office Action dated Feb. 1, 2007 from Related U.S. Appl. No. 11/130,562.
Office Action dated Feb. 13, 2009 from Related U.S. Appl. No. 12/033,765.
Office Action dated Feb. 13, 2009 from Related U.S. Appl. No. 12/050,821.
Office Action dated Feb. 15, 2008 from Related U.S. Appl. No. 11/417,557.
Office Action dated Feb. 3, 2009 from Related U.S. Appl. No. 11/866,295.
Office Action dated Jan. 18, 2006 from Related U.S. Appl. No. 11/130,601.
Office Action dated Jan. 18, 2006 from Related U.S. Appl. No. 11/130,871.
Office Action dated Jan. 23, 2007 from Related U.S. Appl. No. 10/916,222.
Office Action dated Jan. 6, 2006 from Related U.S. Appl. No. 11/130,562.
Office Action dated Jan. 6, 2006 from Related U.S. Appl. No. 10/916,222.
Office Action dated Jul. 1, 2008 from Related U.S. Appl. No. 11/927,425.
Office Action dated Jul. 11, 2006 from Related U.S. Appl. No. 11/130,562.
Office Action dated Jul. 11, 2006 from Related U.S. Appl. No. 10/916,222.
Office Action dated Jul. 11, 2007 from Related U.S. Appl. No. 11/417,609.
Office Action dated Jul. 11, 2007 from Related U.S. Appl. No. 11/417,701.
Office Action dated Jul. 16, 2008 from Related U.S. Appl. No. 11/417,701.
Office Action dated Jul. 24, 2008 from Related U.S. Appl. No. 11/417,557.
Office Action dated Jul. 27, 2006 from Related U.S. Appl. No. 11/130,871.
Office Action dated Jun. 17, 2009 from Related U.S. Appl. No. 12/033,765.
Office Action dated Jun. 19, 2009 from Related U.S. Appl. No. 11/866,295.
Office Action dated Jun. 22, 2009 from Related U.S. Appl. No. 12/050,821.
Office Action dated Jun. 27, 2007 from Related U.S. Appl. No. 11/417,557.
Office Action dated Mar. 30, 2006 from Related U.S. Appl. No. 11/130,569.
Office Action dated May 4, 2005 from Related U.S. Appl. No. 10/916,223.
Office Action dated May 6, 2009 from Related U.S. Appl. No. 11/830,729.
Office Action dated Nov. 14, 2006 from Related U.S. Appl. No. 11/130,569.
Office Action dated Nov. 16, 2006 from Related U.S. Appl. No. 10/916,223.
Office Action dated Nov. 8. 2005 from Related U.S. Appl. No. 10/916,222.
Office Action dated Nov. 9. 2005 from Related U.S. Appl. No. 11/130,562.
Office Action dated Nov. 9. 2005 from Related U.S. Appl. No. 11/130,601.
Office Action dated Nov. 9. 2005 from Related U.S. Appl. No. 11/130,871.
Office Action dated Oct. 27, 2005 from Related U.S. Appl. No. 10/916,223.
Office Action dated Sep. 18, 2007 from Related U.S. Appl. No. 11/130,562.
Office Action for U.S. Appl. No. 13/269,188 dated Feb. 10, 2015.
Office Action for U.S. Appl. No. 13/767,479 dated Feb. 6, 2015.
Office Action for U.S. Appl. No. 13/835,621 dated Dec. 29, 2014.
Office Action for Canadian Application No. 2,828,740 dated Jan. 12. 2015.
Office Action for related U.S. Appl. No. 13/269,188, dated Oct. 6, 2014.
Office Action for related U.S. Appl. No. 13/767,479, dated Oct. 21, 2014.
Office Action for U.S. Appl. No. 11/394,380, dated Jan. 6, 2009.
Office Action for U.S. Appl. No. 11/497,579, dated Oct. 27, 2009.
Office Action for U.S. Appl. No. 11/497,644, dated Dec. 19, 2008.
Office Action for U.S. Appl. No. 11/497,644, dated Jul. 10, 2009.
Office Action from U.S. Appl. No. 13/369,067 dated Apr. 3, 2015.
Office Action regarding U.S. Appl. No. 13/770,479, dated Mar. 16, 2015.
Office Action regarding U.S. Appl. No. 13/770,123, dated Apr. 2, 2015.
Office Action regarding Australian Patent Application No. 2013323760, dated Sep. 25, 2015.
Office Action regarding Australian Patent Application No. 2015207920, dated Dec. 4, 2015.
Office Action regarding Chinese Patent Application No. 201380005300.2, dated Jan. 4, 2016. Translation provided by Unitalen Attorneys at Law.
Office Action regarding Chinese Patent Application No. 201380049458.X, dated Nov. 13, 2015. Translation provided by Unitalen Attorneys at Law.
Office Action regarding Indian Patent Application No. 733/KOLNP/2009, dated Aug. 12, 2015.
Office Action regarding U.S. Appl. No. 10/286,419, dated Jun. 10, 2004.
Office Action regarding U.S. Appl. No. 11/120,166, dated Oct. 2, 2006.
Office Action regarding U.S. Appl. No. 11/120,166, dated Oct. 2, 2007.
Office Action regarding U.S. Appl. No. 11/120,166, dated Dec. 15, 2008.
Office Action regarding U.S. Appl. No. 11/120,166, dated Feb. 17, 2010.

(56) References Cited

OTHER PUBLICATIONS

Office Action regarding U.S. Appl. No. 11/120,166, dated Apr. 12, 2007.
Office Action regarding U.S. Appl. No. 11/120,166, dated Jun. 5, 2008.
Office Action regarding U.S. Appl. No. 11/120,166, dated Jul. 20, 2009.
Office Action regarding U.S. Appl. No. 11/394,380, dated Sep. 25, 2009.
Office Action regarding U.S. Appl. No. 11/497,644, dated Jan. 29, 2010.
Office Action regarding U.S. Appl. No. 11/497,644, dated Jun. 14, 2010.
Office Action regarding U.S. Appl. No. 14/209,415, dated Sep. 10, 2015.
Office Action regarding U.S. Appl. No. 14/212,632, dated Nov. 19, 2015.
Office Action regarding U.S. Appl. No. 14/255,519, dated Nov. 9, 2015.
Office Action regarding U.S. Appl. No. 10/061,964, dated Oct. 3, 2003.
Office Action regarding U.S. Appl. No. 10/675,137, dated Feb. 4, 2005.
Office Action regarding U.S. Appl. No. 10/675,137, dated Jun. 29, 2005.
Office Action regarding U.S. Appl. No. 10/675,137, dated Sep. 7, 2004.
Office Action regarding U.S. Appl. No. 10/698,048, dated Mar. 21, 2005.
Office Action regarding U.S. Appl. No. 10/940,877, dated Oct. 27, 2006.
Office Action regarding U.S. Appl. No. 10/940,877, dated Nov. 14, 2005.
Office Action regarding U.S. Appl. No. 10/940,877, dated Dec. 8, 2008.
Office Action regarding U.S. Appl. No. 10/940,877, dated May 21, 2007.
Office Action regarding U.S. Appl. No. 10/940,877, dated Jun. 5, 2008.
Office Action regarding U.S. Appl. No. 11/256,641, dated Apr. 29, 2008.
Office Action regarding U.S. Appl. No. 11/337,918, dated Mar. 25, 2008.
Office Action regarding U.S. Appl. No. 11/337,918, dated Aug. 17, 2009.
Office Action regarding U.S. Appl. No. 11/337/918, dated Oct. 28, 2008.
Office Action regarding U.S. Appl. No. 13/303,286, dated Mar. 26, 2012.
Palani, M. et al, Monitoring the Performance of a Residential Central Air Conditioner under Degraded Conditions on a Test Bench, ESL-TR-92/05-05, May 1992.
Palani, M. et al, The Effect of Reducted Evaporator Air Flow on the Performance of a Residential Central Air Conditioner, ESL-HH-92-05-04, Energy Systems Laboratory. Mechanical Engineering Department, Texas A&M University, Eighth Symposium on Improving Building System in Hot and Humid Climates, May 13-14, 1992.
Patent Examination Report for Austrialian Application No. 2012223466 dated Jan. 6, 2015.
Pin, C. et al., "Predictive Models as Means to Quantify the Interactions of Spoilage Organisms," International Journal of Food Microbiology, vol. 41, No. 1, 1998, pp. 59-72, XP-002285119.
Reh, F. John, "Cost Benefit Analysis", http://management.about.com/cs/money/a/CostBenefit.htm, Dec. 8, 2003.
Restriction from related Application No. 13/269,188 dated Apr. 9, 2013; 5 pages.
Restriction Requirement regarding U.S. Appl. No. 14/244.967, dated Jul. 14, 2015.
Restriction Requirement regarding U.S. Appl. No. 10/940,877, dated Jul. 25, 2005.
Restriction Requirement regarding U.S. Appl. No. 11/214,179, dated Feb. 2, 2010.
Search Report regarding European Patent Application No. 08251185.8-1605/2040016, dated Dec. 4, 2015.
Search Report regarding European Patent Application No. 13736303.2-1806, dated Sep. 17, 2015.
Second Examination Communication regarding European Application No. EP02729051.9, dated Jul. 3, 2006.
Second Office Action from the State Intellectual Property Office of People's Republic of China regarding Chinese Patent Application No. 201110349785.X, dated Jul. 25, 2014. Translation provided by Unitalen Attorneys at Law.
Second Office Action received from the Chinese Patent Office dated Jun. 26, 2009 regarding Application No. 200480011463.2, translated by CCPIT Patent and Trademark Law Office.
Second Official Report regarding Australian Patent Application No. 2007214381, dated Oct. 30, 2009.
Supplementary European Search Report for EP 02 73 1544, dated Jun. 18, 2004, 2 Pages.
Supplementary European Search Report regarding Application No. PCT/US2006/005917, dated Nov. 23, 2009.
Supplementary European Search Report regarding European Application No. EP06790063, dated Jun. 15, 2010.
Tamarkin, Tom D., "Automatic Meter Reading," Public Power magazine, vol. 50, No. 5, Sep.-Oct. 1992, http://www.energycite.com/news/amr.html, 6 pages.
Texas Instruments, Inc. Mechanical Data for "PT (S-PQFP-348) Plastic Quad Flatpack," Revised Dec. 1996, 2 pages.
Texas Instruments, Inc., Product catalog for "TRF690 1 Single-Chip RF Transceiver," Copyright 2001-2003, Revised Oct. 2003, 27 pages.
The Honeywell HVAC Service Assistant, A Tool for Reducing Electrical Power Demand and Energy Consumption, Field Diagnostics, 2003.
The LS2000 Energy Management System, User Guide, http://www.surfnetworks.com/htmlmanuals/lonWorksEnergyManagement-LS2000-Load-Shed-System-by-Surf-Networks,Inc.html, Sep. 2004, 20 pages.
Third Chinese Office Action regarding Application No. 201110349785.X, dated Jan. 30, 2015. Translation provided by Unitalen Attorneys at Law.
Torcellini, P., et al., "Evaluation of the Energy Performance and Design Process of the Thermal Test Facility at the National Renewable Energy Laboratory", dated Feb. 2005.
Trane EarthWise™ CenTra Vac™ Water-Cooled Liquid Chillers 165-3950 Tons 50 and 60 Hz; CTV PRC007 -EN; Oct. 2002; 56 pages.
U.S. Office Action regarding U.S. Appl. No. 13/269,188, dated May 8, 2015.
U.S. Office Action regarding U.S. Appl. No. 14/212,632, dated May 15, 2015.
Udelhoven, Darrell, "Air Conditioner EER, SEER Ratings, BTUH Capacity Ratings, & Evaporator Heat Load," http://www.udarrell.com/air-conditioner-capacity-seer.html, Apr. 3, 2003, 15 pages.
Udelhoven, Darrell, "Air Conditioning System Sizing for Optimal Efficiency," http://www.udarrell.com/airconditioning-sizing.html, Oct. 6, 2003, 7 pages.
Office Action regarding U.S. Appl. No. 14/193,568, dated Jun. 1, 2016.
Advisory Action regarding U.S. Appl. No. 14/193,568, dated Aug. 10, 2016.
Office Action regarding U.S. Appl. No. 14/244,967, dated Aug. 29, 2016.
Advisory Action regarding U.S. Appl. No. 14/212,632, dated Feb. 9, 2016.
Office Action regarding U.S. Appl. No. 14/244,967, dated Feb. 12, 2016.
Office Action regarding European Patent Application No. 08848538.8-1608, dated Feb. 3, 2016.
Advisory Action regarding U.S. Appl. No. 14/212,632, dated Mar. 8, 2016.

(56) References Cited

OTHER PUBLICATIONS

Office Action regarding U.S. Appl. No. 14/209,415, dated Mar. 10, 2016.
Office Action regarding U.S. Appl. No. 14/212,632, dated Apr. 7, 2016.
Office Action regarding U.S. Appl. No. 12/943,626, dated May 4, 2016.
Office Action regarding Australian Patent Application No. 2014229103, dated Apr. 28, 2016.
Office Action regarding U.S. Appl. No. 14/617,451, dated Jun. 2, 2016.
Office Action regarding U.S. Appl. No. 14/080,473, dated Jun. 6, 2016.
Interview Summary regarding U.S. Appl. No. 14/209,415, dated Jun. 20, 2016.
Search Report regarding European Patent Application No. 13841699.5, dated Jun. 30, 2016.
Office Action regarding Chinese Patent Application No. 201480016023.X, dated Jun. 22, 2016. Translation provided by Unitalen Attorneys at Law.
Interview Summary regarding U.S. Appl. No. 14/617,451, dated Jul. 28, 2016.
Office Action regarding U.S. Appl. No. 14/208,636, dated Aug. 4, 2016.
Office Action regarding U.S. Appl. No. 14/727,756, dated Aug. 22, 2016.
Office Action regarding U.S. Appl. No. 14/244,967, dated Aug. 30, 2016.
Office Action regarding U.S. Appl. No. 13/770,479, dated Sep. 7, 2016.
Office Action regarding U.S. Appl. No. 15/096,196, dated Sep. 13, 2016.
Office Action regarding Canadian Patent Application No. 2,904,734, dated Sep. 13, 2016.
Office Action regarding U.S. Appl. No. 14/300,782, dated Sep. 30, 2016.
Office Action regarding U.S. Appl. No. 14/255,519, dated Oct. 5, 2016.
Office Action regarding Australian Patent Application No. 2015255255, dated Sep. 8, 2016.
Office Action regarding Canadian Patent Application No. 2,908,362, dated Sep. 21, 2016.
Search Report regarding European Patent Application No. 14764311.8, dated Oct. 27, 2016.
Search Report regarding European Patent Application No. 14763232.7, dated Oct. 27, 2016.
Office Action regarding U.S. Appl. No. 12/943,626, dated Nov. 4, 2016.
Louis Goodman et al. "Vertical Motion of Neutrally Buoyant Floats." Journal of Atmospheric and Oceanic Technology. vol. 7, Feb. 1990.
Search Report regarding European Patent Application No. 14780284.7, dated Nov. 2, 2016.
Office Action regarding U.S. Appl. No. 14/080,473, dated Nov. 16, 2016.
Applicant-Initiated Interview Summary regarding U.S. Appl. No. 13/770,479, dated Dec. 9, 2016.
Office Action regarding U.S. Appl. No. 14/244,967, dated Jan. 20, 2017.
Search Report regarding European Patent Application No. 16187893.9, dated Jan. 19, 2017.
Advisory Action regarding U.S. Appl. No. 14/080,473, dated Jan. 30, 2017.
Office Action regarding U.S. Appl. No. 14/208,636, dated Jan. 26, 2017.
Office Action regarding Indian Patent Application No. 102/KOLNP/2009, dated Mar. 10, 2017.
Office Action regarding U.S. Appl. No. 14/080,473, dated Mar. 14, 2017.
Office Action regarding U.S. Appl. No. 13/770,479, dated Mar. 17, 2017.
Advisory Action regarding U.S. Appl. No. 14/208,636, dated Mar. 23, 2017.
Richard E. Lofftus, Jr. "System Charge and Performance Evaluation." HVAC/R Training, Vatterott College. Jan. 2007.
Search Report regarding European Patent Application No. 12752872.7, dated May 4, 2017.
Interview Summary regarding U.S. Appl. No. 13/770,479, dated May 10, 2017.
Advisory Action and Examiner-Initiated Interview Summary regarding U.S. Appl. No. 13/770,479, dated May 23, 2017.
U.S. Appl. No. 15/450,404, filed Mar. 6, 2017.
Office Action regarding Canadian Patent Application No. 2,934,860, dated May 4, 2017.

* cited by examiner

SYSTEM FOR REFRIGERANT CHARGE VERIFICATION USING TWO CONDENSER COIL TEMPERATURES

CROSS-REFERENCE TO RELATED APPLICATIONS

This application claims the benefit of U.S. Provisional Application No. 61/789,913, filed on Mar. 15, 2013. The entire disclosure of the above application is incorporated herein by reference.

FIELD

The present disclosure relates to refrigeration systems and more specifically to a charge-verification system for use with a refrigeration system.

BACKGROUND

The statements in this section merely provide background information related to the present disclosure and may not constitute prior art.

Compressors are used in a wide variety of industrial and residential applications to circulate refrigerant within a refrigeration, heat pump, HVAC, or chiller system (generically referred to as "refrigeration systems") to provide a desired heating and/or cooling effect. In any of the foregoing systems, the compressor should provide consistent and efficient operation to ensure that the particular refrigeration system functions properly.

Refrigeration systems and associated compressors may include a protection system that selectively restricts power to the compressor to prevent operation of the compressor and associated components of the refrigeration system (i.e., evaporator, condenser, etc.) when conditions are unfavorable. The types of faults that may cause protection concerns include electrical, mechanical, and system faults. Electrical faults typically have a direct effect on an electrical motor associated with the compressor, while mechanical faults generally include faulty bearings or broken parts. Mechanical faults often raise a temperature of working components within the compressor and, thus, may cause malfunction of and possible damage to the compressor.

In addition to electrical and mechanical faults associated with the compressor, the compressor and refrigeration system components may be affected by system faults attributed to system conditions such as an adverse level of fluids (i.e., refrigerant) disposed within the system or a blocked-flow condition external to the compressor. Such system conditions may raise an internal compressor temperature or pressure to high levels, thereby damaging the compressor and causing system inefficiencies and/or failures.

SUMMARY

A charge-verification system for a circuit including a condenser having an inlet, an outlet, and a coil circuit tube extending between the inlet and the outlet is provided. The charge-verification system may include a first of coil temperature sensor located on the coil circuit tube a first distance from the inlet and a second of coil temperature sensor located on the coil circuit tube a second distance from the inlet. The charge-verification system may also include a controller receiving a first signal from the first temperature sensor indicative of a first temperature and a second signal from the second temperature sensor indicative of a second temperature. The controller may determine which of the first signal and the second signal is closer to an actual saturated condensing temperature of the condenser.

A method of charge-verification of a circuit including a condenser having an inlet, an outlet, and a coil circuit tube extending between the inlet and the outlet is also provided. The method may include determining a first temperature of the coil circuit tube at a first distance from the inlet of the condenser, determining a second temperature of the coil circuit tube at a second distance from the inlet of the condenser, providing the first temperature to a controller, and providing the second temperature to the controller. The method may also include determining by the controller which of the first temperature and the second temperature is closer to an actual saturated condensing temperature of the condenser.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The drawings described herein are for illustration purposes only and are not intended to limit the scope of the present disclosure in any way. The present disclosure will become more fully understood from the detailed description and the accompanying drawings, wherein.

DETAILED DESCRIPTION

Figure 1:
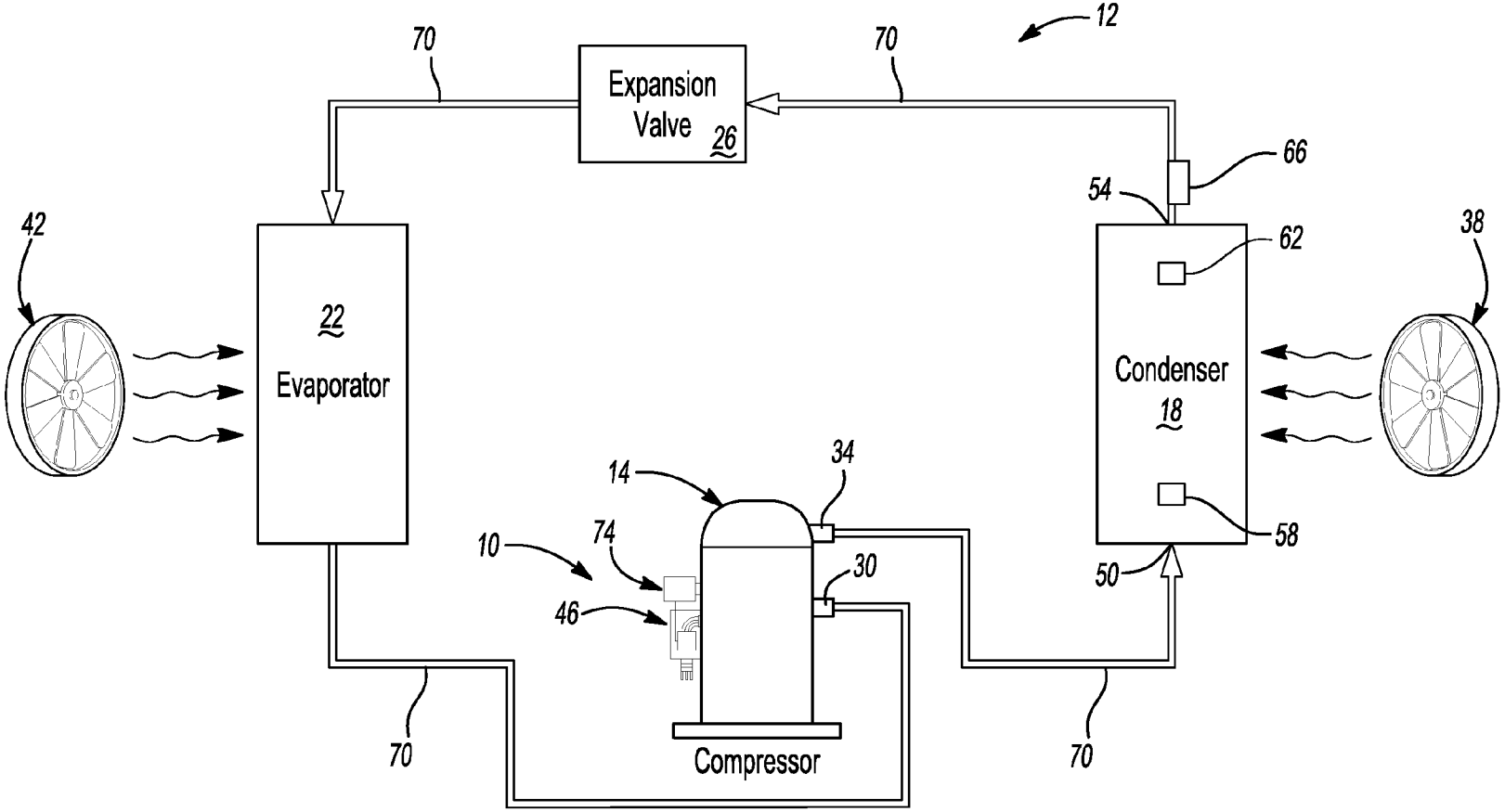
FIG. 1 is a schematic representation of charge-verification system in accordance with the principles of the present disclosure implemented in a refrigeration system.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a charge-verification system 10 is provided. The charge-verification system 10 may be used in conjunction with a refrigeration system 12 including a compressor 14, a condenser 18, an evaporator 22, and an expansion valve 26. While the refrigeration system 12 is described and shown as including a compressor 14, a condenser 18, an evaporator 22, and an expansion valve 26, the refrigeration system 12 may include additional and/or alternative components. Further, the present disclosure is applicable to various types of refrigeration systems including, but not limited to, heating, ventilating, air conditioning (HVAC), heat pump, refrigeration, and chiller systems.

During operation of the refrigeration system 12, the compressor 14 circulates refrigerant generally between the condenser 18 and the evaporator 22 to produce a desired heating and/or cooling effect. Specifically, the compressor 14 receives refrigerant in vapor form through an inlet fitting 30 and compresses the refrigerant. The compressor 14 provides pressurized refrigerant in vapor form to the condenser 18 via a discharge fitting 34.

All or a portion of the pressurized refrigerant received from the compressor 14 may be converted into the liquid state within the condenser 18. Specifically, the condenser 18 transfers heat from the refrigerant to the surrounding air, thereby cooling the refrigerant. When the refrigerant vapor is cooled to a temperature that is less than a saturation temperature, the refrigerant changes state from a vapor to a liquid. The condenser 18 may include a condenser fan 38 that increases the rate of heat transfer away from the refrigerant by forcing air across a heat-exchanger coil associated with the condenser 18. The condenser fan 38 may be a variable-speed fan that is controlled by the charge-verification system 10 based on a cooling demand.

The refrigerant passes through the expansion valve 26 prior to reaching the evaporator 22. The expansion valve 26 expands the refrigerant prior to the refrigerant reaching the evaporator 22. A pressure drop caused by the expansion valve 26 may cause a portion of the liquefied refrigerant to change state from a liquid to a vapor. In this manner, the evaporator 22 may receive a mixture of vapor refrigerant and liquid refrigerant.

The refrigerant absorbs heat in the evaporator 22. Accordingly, liquid refrigerant disposed within the evaporator 22 changes state from a liquid to a vapor when warmed to a temperature that is greater than or equal to the saturation temperature of the refrigerant. The evaporator 22 may include an evaporator fan 42 that increases the rate of heat transfer to the refrigerant by forcing air across a heat-exchanger coil associated with the evaporator 22. The evaporator fan 42 may be a variable-speed fan that is controlled by the charge-verification system 10 based on a cooling demand.

As the liquid refrigerant absorbs heat, the ambient air disposed proximate to the evaporator 22 is cooled. The evaporator 22 may be disposed within a space to be cooled such as a building or refrigerated case where the cooling effect produced by the refrigerant absorbing heat is used to cool the space. The evaporator 22 may also be associated with a heat-pump refrigeration system where the evaporator 22 may be located remote from the building such that the cooling effect is lost to the atmosphere and the rejected heat generated by the condenser 18 is directed to the interior of a space to be heated.

A system controller 46 may be associated with the charge-verification system 10 and/or the compressor 14 and may monitor, control, protect, and/or diagnose the compressor 14 and/or the refrigeration system 12. The system controller 46 may utilize a series of sensors to determine both measured and non-measured operating parameters of the compressor 14 and/or the refrigeration system 12. While the system controller 46 is shown as being associated with the compressor 14, the system controller 46 could be located anywhere within or outside of the refrigeration system 12. The system controller 46 may use the non-measured operating parameters in conjunction with the measured operating parameters to monitor, control, protect, and/or diagnose the compressor 14 and/or the refrigeration system 12. Such non-measured operating parameters may also be used to check the sensors to validate the measured operating parameters and to determine a refrigerant charge level and/or a fault of the refrigeration system 12.

The system controller 46 may control the condenser fan 38 and the evaporator fan 42 such that operation of the condenser fan 38 and the evaporator fan 42 is coordinated with operation of the compressor 14. For example, the system controller 46 may control one or both fans 38, 42 to operate at a full or reduced speed depending on the output of the compressor 14.

The condenser 18, having an inlet 50 and an outlet 54, may further include a first coil temperature sensor 58 and a second coil temperature sensor 62 positioned on first and second heat-exchanger coil circuit tubes (not shown). The first coil temperature sensor 58 may be located within a first predetermined range of the coil circuit length from the condenser inlet 50. For example, the first coil temperature sensor 58 may be located at approximately forty percent of the coil circuit length from the condenser inlet 50 or at any location between thirty percent and fifty percent of the coil circuit length from the condenser inlet 50. The second coil temperature sensor 62 may be located within a second predetermined range of the coil circuit length from the condenser inlet 50. For example, the second coil temperature sensor 62 may be located at approximately seventy percent of the coil circuit length from the condenser inlet 50 or at any location between sixty percent and ninety percent of the coil circuit length from the condenser inlet 50. The first and second coil temperature sensors 58, 62 detect a temperature of the refrigerant circulating in the condenser 18 and may be used by the system controller 46 of the charge-verification system 10 to determine a saturated condensing temperature (SCT) of the refrigerant.

While the condenser 18 is illustrated as a Plate-Fin Heat Exchanger Coil, the present disclosure is applicable to other heat exchangers such as a smaller 5 mm microtube, a Microchannel, Spine-Fin Heat Exchanger Coils, or other heat exchangers known in the art. Further, the condensing coil may include various different parallel circuits with different heat exchanger designs. The first and second coil temperature sensors 58, 62 may be associated with any of the heat exchangers of the various parallel circuits.

A liquid-line temperature sensor 66 may be located along a conduit 70 extending between the condenser 18 and the expansion valve 26 and may provide an indication of a temperature of the liquid refrigerant within the refrigeration system 12 or liquid-line temperature (LLT) to the system controller 46. While the liquid-line temperature sensor 66 is described as being located along the conduit 70 extending between the condenser 18 and the expansion valve 26, the liquid-line temperature sensor 66 could alternatively be placed anywhere within the refrigeration system 12 that allows the liquid-line temperature sensor 66 to provide an indication of a temperature of liquid refrigerant within the refrigeration system 12 to the system controller 46.

An outdoor/ambient temperature sensor 74 may be located external to the compressor 14 and generally provides an indication of the outdoor/ambient temperature (OAT) adjacent to the compressor 14 and/or the charge-verification system 10. The outdoor/ambient temperature sensor 74 may be positioned adjacent to the compressor 14 such that the outdoor/ambient temperature sensor 74 is in close proximity to the system controller 46. Placing the outdoor/ambient temperature sensor 74 in close proximity to the compressor 14 provides the system controller 46 with a measure of the temperature generally adjacent to the compressor 14. While the outdoor/ambient temperature sensor 74 is described as being located adjacent to the compressor 14, the outdoor/ambient temperature sensor 74 could be placed anywhere within the refrigeration system 12 that allows the outdoor/ambient temperature sensor 74 to provide an indication of the outdoor/ambient temperature proximate to the compressor 14 to the system controller 46. Additionally, or alternatively, local weather data could be retrieved using the internet, for example, to determine ambient temperature.

The system controller 46 receives sensor data from the coil temperature sensors 58, 62, the liquid-line temperature sensor 66, and the outdoor/ambient temperature sensor 74 for use in controlling and diagnosing the refrigeration system 12 and/or the compressor 14. The system controller 46 may additionally use the sensor data from the respective sensors 58, 62, 66, and 74 to determine non-measured operating parameters of the refrigeration system 12 and/or the compressor 14 using the relationships shown in FIGS. 3, 4, 5, 6, and 7.

The system controller 46 determines which of the temperatures received from the first coil temperature sensor 58 and the second coil temperature sensor 62 is closer to the actual SCT and uses that sensor in conjunction with the temperature reading from the liquid-line temperature sensor 66 to determine a subcooling and the charge level of the refrigeration system 12, as will be described in greater detail below.

Figure 2:
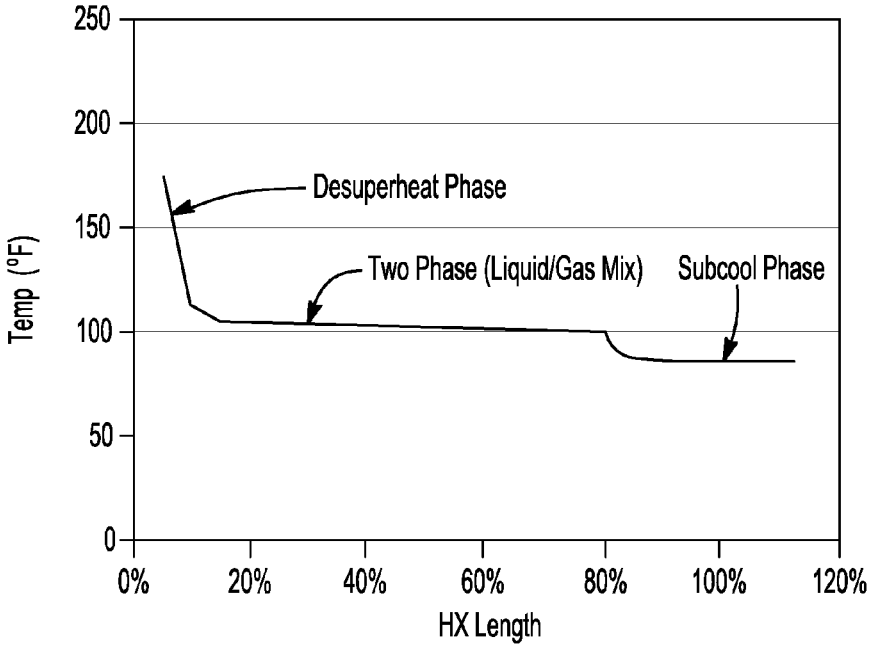
FIG. 2 is a graph showing coil temperature versus a percentage position of the coil circuit length during a normal charge condition according to the present disclosure.

With particular reference to FIG. 2, a graph showing coil temperature versus a percentage position of the coil circuit length during a normal charge condition is illustrated. Upon exiting the condenser 18, approximately ten to twenty percent of the refrigerant is in a gaseous state or de-superheating phase, approximately ten to twenty percent of the refrigerant is in a liquid state or subcooling phase, and the remaining sixty to seventy percent of the refrigerant is in a liquid/vapor state or two-phase condensing state. The subcooling phase typically yields approximately ten degrees Fahrenheit (10° F.) subcooling and is considered a normal charge level.

When the charge-verification system 10 operates under normal charge conditions, placement of the temperature sensor on a coil circuit tube at approximately a midpoint of the condenser 18 provides the system controller 46 with an indication of the temperature of the condenser 18 that approximates the saturated condensing temperature and saturated condensing pressure. When the charge-verification system 10 is normally charged such that the refrigerant within the refrigeration system 12 is within +/−fifteen percent of an optimum-charge condition, the information detected by the temperature sensor positioned at approximately the midpoint of the coil circuit tube is closer to the actual SCT.

Figure 3:
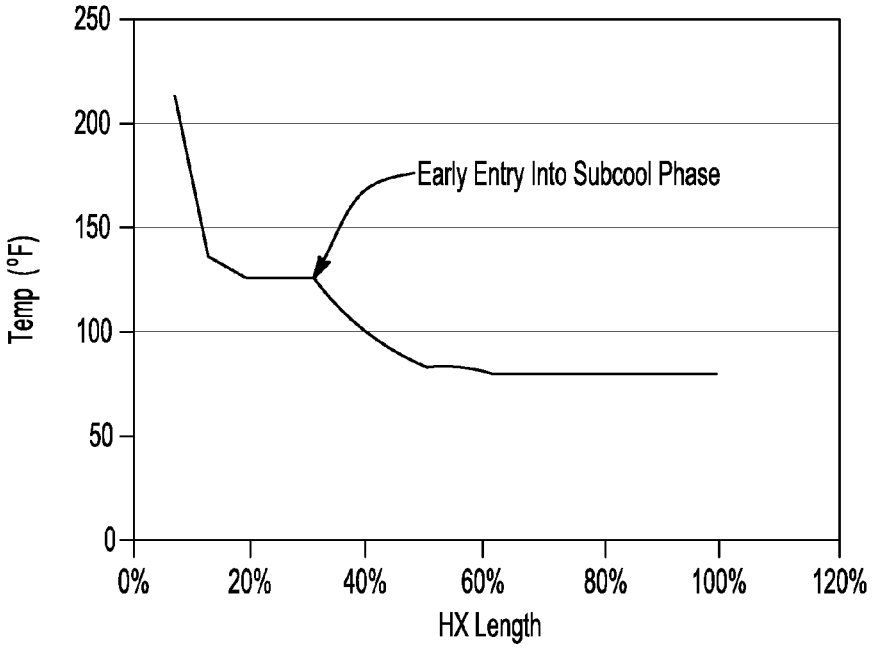
FIG. 3 is a graph showing coil temperature versus a percentage position of the coil circuit length during an overcharge condition according to the present disclosure.

With particular reference to FIG. 3, a graph showing coil temperature versus a percentage position of the coil circuit length during an overcharge condition is illustrated. An overcharge condition may exist when the subcooling temperature is greater than approximately thirty degrees Fahrenheit (30° F.). When the condenser 18 is in an overcharge state, the coil mid-point temperature may already be subcooled, thus providing a much lower value than actual SCT based on pressure. An excess amount of refrigerant may be disposed within the refrigeration system 12, as the refrigerant disposed within the condenser 18 changes state from a gas to a liquid before reaching the midpoint of the condenser 18.

The refrigerant exiting the compressor 14 and entering the condenser 18 is at a reduced temperature and may be in an approximately 40/60 gas/liquid mixture. The reduced-temperature refrigerant converts from the vapor state to the liquid state at an earlier point along the length of the condenser 18 and therefore may be at a partial or fully liquid state when the refrigerant approaches the temperature sensor disposed at the midpoint of the condenser 18. Because the refrigerant is at a lower temperature, the temperature sensor at the midpoint reports a temperature to the system controller 46 that is lower than the actual SCT.

When the refrigeration system 12 operates in the overcharge condition, the subcooled liquid phase increases and the reading of the second coil temperature sensor 62 may be lower than the reading of the first coil temperature sensor 58 because the tube where the second coil temperature sensor is located is subcooled compared to the tube where the first coil temperature sensor is located. Therefore, during an overcharge condition, the temperature from the first coil temperature sensor 58 is closer to the actual SCT than the temperature from the second coil temperature sensor 62.

Figure 4:
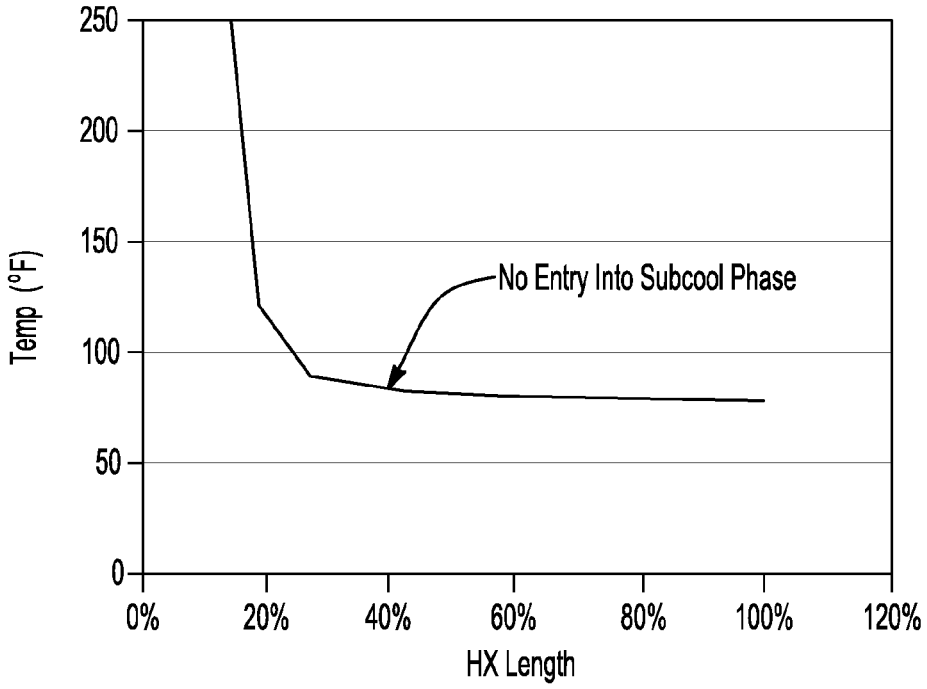
FIG. 4 is a graph showing coil temperature versus a percentage position of the coil circuit length during an undercharge condition according to the present disclosure.

With particular reference to FIG. 4, a graph showing coil temperature versus a percentage position of the coil circuit length during an undercharge condition is illustrated. An undercharge condition may exist when the subcooling temperature is less than zero degrees Fahrenheit (0° F.). When the condenser 18 is in an undercharge state, any coil circuit tube after approximately the twenty percent de-superheating phase adequately measures the actual SCT temperature because the remaining portion of the condenser 18 is in two-phase condensing without any subcooled liquid phase.

When the refrigeration system 12 operates in the undercharge condition, the subcooled liquid phase decreases and the reading of the second coil temperature sensor 62 may approach the reading of the outlet liquid-line temperature sensor 66. Eventually, when the subcooling phase disappears because both sensors 58, 62 are detecting only the condensing phase, the readings of temperature sensors 58, 62 are approximately equal. In this situation, the temperature from the first coil temperature sensor 58 approximately equals the temperature from the second coil temperature sensor 62, which, in turn, approximates the actual SCT.

Figure 5:
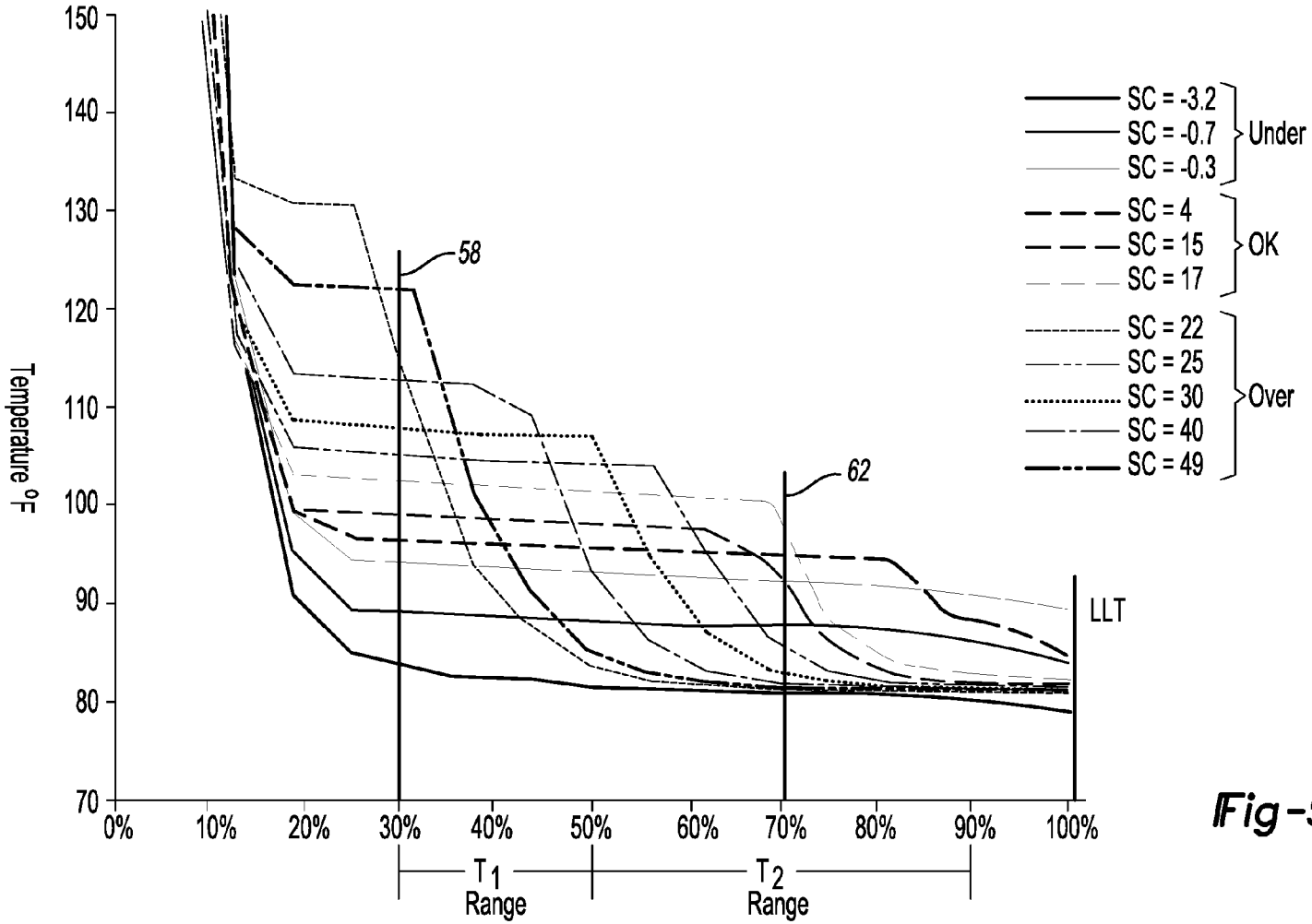
FIG. 5 is a graph showing coil temperature versus a percentage position of the coil circuit length for two coil temperature sensors mounted at approximately forty percent and seventy percent, respectively, of the coil circuit length according to the present disclosure.

With reference to FIG. 5, a graph showing coil temperature versus a percentage position of the coil circuit length is illustrated. The positions of the first and second coil temperature sensors 58, 62 along a length of the condenser 18 are schematically represented by vertical lines at approximately thirty percent (30%) and seventy percent (70%), respectively. Each plotted line on the graph represents a different charge condition. Intersection between the plotted lines and the respective vertical lines of the first and second coil temperature sensors 58, 62 may be used by the controller 46 to identify amongst the various charge conditions.

In the condensing phase, the temperature changes mainly as a function of pressure drop; thus, the temperature changes very gradually, at approximately less than three degrees (3° F.) per coil circuit. When in the subcooled phase, the temperature changes much more rapidly, at approximately greater than ten degrees (10° F.) per coil circuit.

When the temperature from the first coil temperature sensor 58 is greater than the temperature from the second coil temperature 62 sensor plus approximately two degrees Fahrenheit (2° F.) and both are greater than the LLT plus approximately seven degrees Fahrenheit (7° F.) (Tcoil1>Tcoil2+2° F.>LLT+7° F.), a normal charge condition is declared. When the temperature from the first coil temperature sensor 58 is approximately equal to the temperature from the second coil temperature sensor 62—which is approximately equal to the LLT (Tcoil1≅Tcoil2≅LLT)—an undercharge condition is declared; indicating that refrigerant should be added to the system. When the temperature from the first coil temperature sensor 58 is greater than the temperature from the second coil temperature sensor 62 plus approximately five degrees Fahrenheit (5° F.) and both are greater than the LLT plus approximately two degrees Fahrenheit (2° F.) (Tcoil1>Tcoil2+5° F.>LLT+2° F.), an overcharge condition is declared; indicating that refrigerant should be removed from the system.

For example, when the refrigeration system 12 is operating in an undercharged condition, the first coil temperature sensor 58 may be reporting eighty-four degrees Fahrenheit (84° F.), eighty-nine degrees Fahrenheit (89° F.), or ninety-five degrees Fahrenheit (95° F.) and the second coil temperature sensor 62 may be reporting eighty-three degrees Fahrenheit (83° F.), eighty-nine degrees Fahrenheit (89° F.), or ninety-four degrees Fahrenheit (94° F.). If the first coil temperature sensor 58 is reporting eighty-four degrees Fahrenheit (84° F.) and the second coil temperature sensor 62 is reporting eighty-three degrees Fahrenheit (83° F.), the subcooling temperature is 3.2° F. If the first coil temperature sensor 58 is reporting eighty-nine degrees Fahrenheit (89° F.) and the second coil temperature sensor 62 is reporting eighty-nine degrees Fahrenheit (89° F.), the subcooling temperature is 0.7° F. If the first coil temperature sensor 58 is reporting ninety-five degrees Fahrenheit (95° F.) and the second coil temperature sensor 62 is reporting ninety-four degrees Fahrenheit (94° F.), the subcooling temperature is 0.3° F. The graph illustrates similar relations for normal operation and overcharged operation as well. The controller 46 may therefore use the data from the first coil temperature sensor 58 and the second coil temperature sensor 62 along with the LLT to diagnose the charge level of the system.

Based on the temperature readings from the first and second coil temperature sensors 58, 62, the system controller 46 determines the subcooling temperature and the charge condition (as shown in FIG. 5). Based on the subcooling temperature and the charge condition, the system controller 46 may determine remedial actions that may be necessary, such as addition of refrigerant to the system or removal of refrigerant from the system.

Dependent upon the amount of refrigerant that needs to be added or removed from the system, the refrigerant may be added or removed in a series of incremental additions or removals to ensure that too much refrigerant is not added or removed. Between each of the series of incremental additions or removals, the system controller 46 may determine the subcooling temperature and the charge condition.

Figure 6:
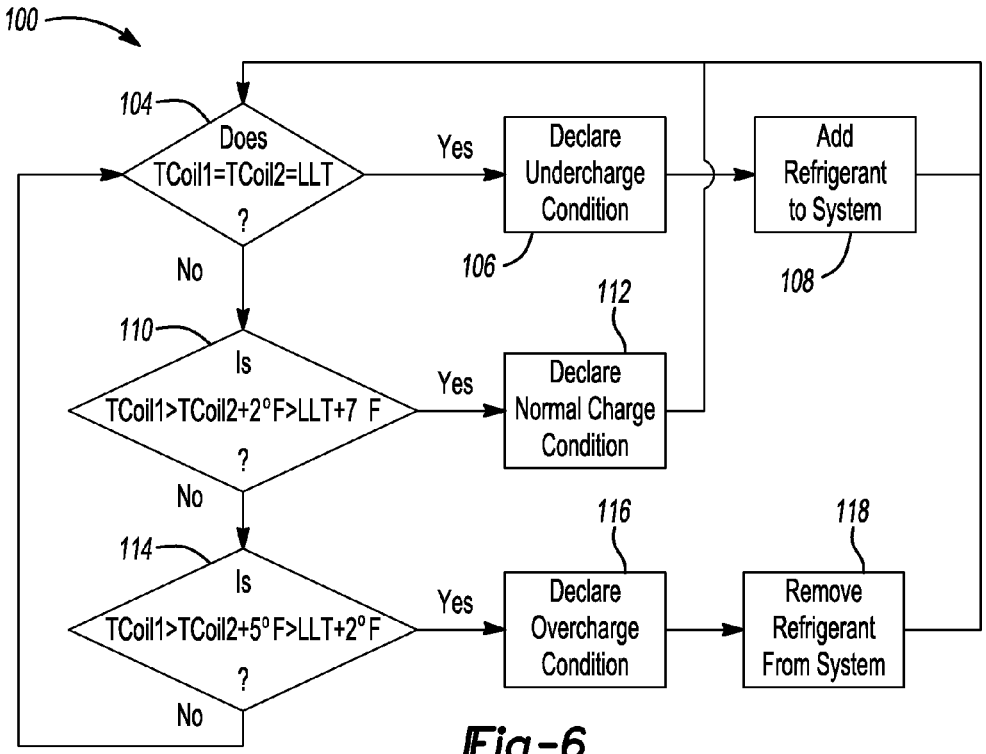
FIG. 6 is a flow chart detailing operation of a charge-verification system according to the present disclosure.

Now referring to FIG. 6, a charge verification method 100 is illustrated. The charge verification method 100 may be performed by the controller 46 during operation of the refrigeration system 12.

At 104, the method 100 determines whether the Tcoil1 equals the Tcoil2 and whether both of these values are approximately equal to the LLT (Tcoil1=Tcoil2=LLT). If true, the method 100 determines that the refrigeration system 12 is operating in an undercharged condition at 106. At step 108, the method 100 recommends adding refrigerant to the system. The method 100 then returns to step 104 to continue evaluating the Tcoil1, the Tcoil2, and the LLT.

If false at step 104, the method 100 determines whether a first coil temperature (Tcoil1) is greater than a second coil temperature (Tcoil2) plus approximately two degrees Fahrenheit (2° F.) and whether both of these values are greater than the LLT plus approximately seven degrees Fahrenheit (7° F.) (Tcoil1>Tcoil2+2° F.>LLT+7° F.) at 110. If true, the method 100 determines that the refrigeration system 12 is operating in a normal charge condition at 112. The method 100 returns to step 104 to continue evaluating the Tcoil1, the Tcoil2, and the LLT.

If false at step 104, the method 100 moves to step 110 and if false at step 110, the method 100 moves to step 114 and determines whether the Tcoil1 is greater than the Tcoil2 plus approximately five degrees Fahrenheit (5° F.) and whether both of these are greater than the LLT plus approximately two degrees Fahrenheit (2° F.) (Tcoil1>Tcoil2+5° F.>LLT+2° F.). If true, the method 100 determines that the refrigeration system 12 is operating in an overcharged condition at 116. At 118, the method 100 recommends removing refrigerant from the system. The method 100 then returns to step 104 to continue evaluating the Tcoil1, the Tcoil2, and the LLT.

If false at step 114, the method 100 returns to step 104 to continue evaluating the Tcoil1, the Tcoil2, and the LLT.

Figure 7:
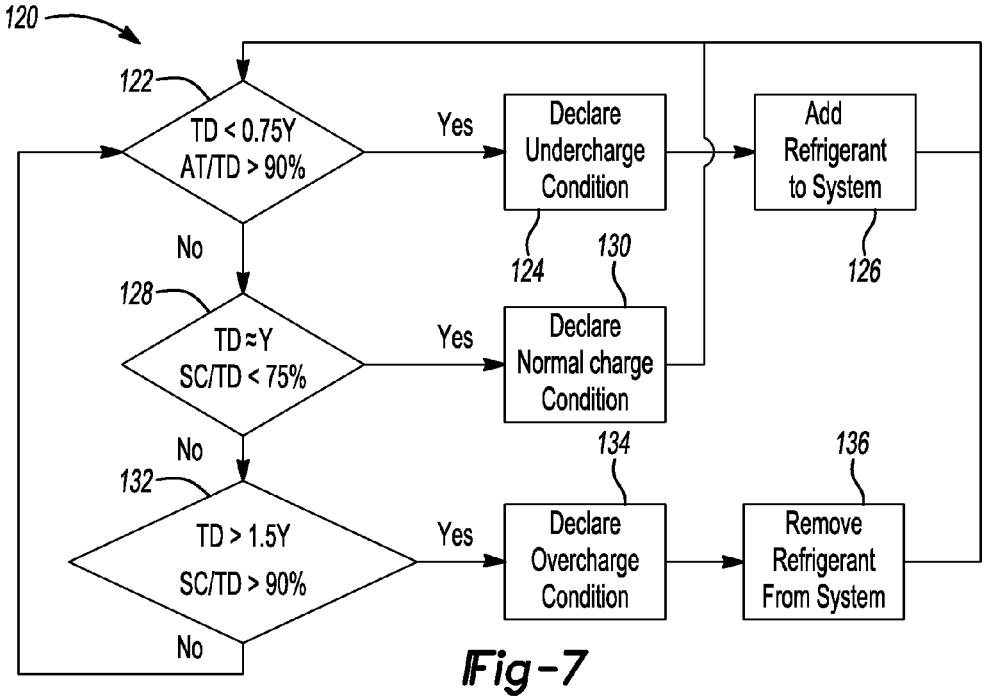
FIG. 7 is a flow chart detailing operation of a charge-verification system accordingly to the present disclosure.

With particular reference to FIG. 7, another charge-verification method 120 is provided. As with the charge-verification method 100, the charge-verification method 120 may be performed by the controller 46 during operation of the refrigeration system 12.

The charge-verification method 120 may be used by the controller 46 in conjunction with or in place of the charge-verification method 100 when determining the charge of the refrigeration system 12. If the methods 100, 120 are used in conjunction with one another, the methods 100, 120 may independently determine the charge of the refrigeration system 12 (i.e., normal charge, undercharge, or overcharge) and may be used by the controller 46 to verify the results of each method 100, 120. Namely, the result obtained by one of the methods 100, 120 may be used by the controller 46 to verify the result obtained by the other method 100, 120 by comparing the results obtained via each method 100, 120.

At 122, the method 120 determines whether the TD is less than approximately 0.75Y (i.e., 75% of Y) and whether a ratio of AT/TD is greater than approximately 90%, whereby the variable (Y) represents a predetermined desired TD value, which may be determined based on system efficiency. If true, the method 120 determines that the refrigeration system 12 is operating in an undercharged condition at 124. At step 126, the method 120 recommends adding refrigerant to the system. The method 120 then returns to step 122 to continue evaluating the system 12.

If false at step 122, the method 120 moves to step 128 and determines whether the TD is approximately equal to the predetermined desired TD value Y (i.e., +/−15% of Y) and whether the ratio of SC/TD is less than approximately 75%. If true, the method 120 determines that the refrigeration system 12 is operating in a normal charge condition at 130. The method 120 returns to step 122 to continue evaluating the system 12.

If false at step 122, the method 120 moves to step 128 and if false at step 128, the method 120 moves to step 132 and determines whether the TD is greater than approximately 1.5Y and whether a ratio of SC/TD is greater than approximately 90%. If true, the method 120 determines that the refrigeration system 12 is operating in an overcharged condition at 134. At 136, the method 120 recommends removing refrigerant from the system. The method 120 then returns to step 122 to continue evaluating the system 12.

If false at step 132, the method 120 returns to step 122 to continue evaluating the system 12.

The controller 46 may execute the foregoing methods 100, 120 simultaneously. Further, while the controller 46 monitors the system 12 for the undercharge condition prior to the normal-charge condition and the overcharge condition, the controller 46 could perform operations 104, 110, 114 of method 100 and operations 122, 128, 132 of method 120 in any order. The controller 46 is only described as performing operations 104 and 122 first, as most commercial refrigeration systems 12 are manufactured and shipped with a small volume of refrigerant and, therefore, are typically in the undercharge condition when initially installed.

In another configuration, the system controller 46 may additionally determine faults in the refrigeration system 12 along with determining the subcooling temperature and the charge condition. For example, the system controller 46 may determine a temperature difference (TD) between the SCT and the OAT (TD=SCT−OAT). The TD increases with an overcharge condition and decreases with an undercharge condition. The system controller 46 may further determine an approach temperature (AT) by subtracting the OAT from the LLT (AT=LLT−OAT). The AT decreases with an overcharge condition and increases with an undercharge condition.

Based on the foregoing, the system controller 46 is able to determine a refrigerant charge level and/or a fault by analyzing the AT, the TD and the SC without requiring additional temperature sensors (as illustrated in FIG. 1). Further, because the TD is equivalent to the SC plus the AT (TD=SC+AT), the percent split or ratio between the SC and the AT (making up the TD) is a good indicator of which fault is occurring.

For overcharge conditions, the TD is high, but the AT is small, thus an SC/TD ratio is greater than approximately ninety percent (90%). For undercharge conditions, the TD is low and the SC is low, thus an AT/TD ratio is greater than approximately ninety percent (90%). Accordingly, the controller 46 may differentiate between other faults as well, as described in detail below.

Figure 9:
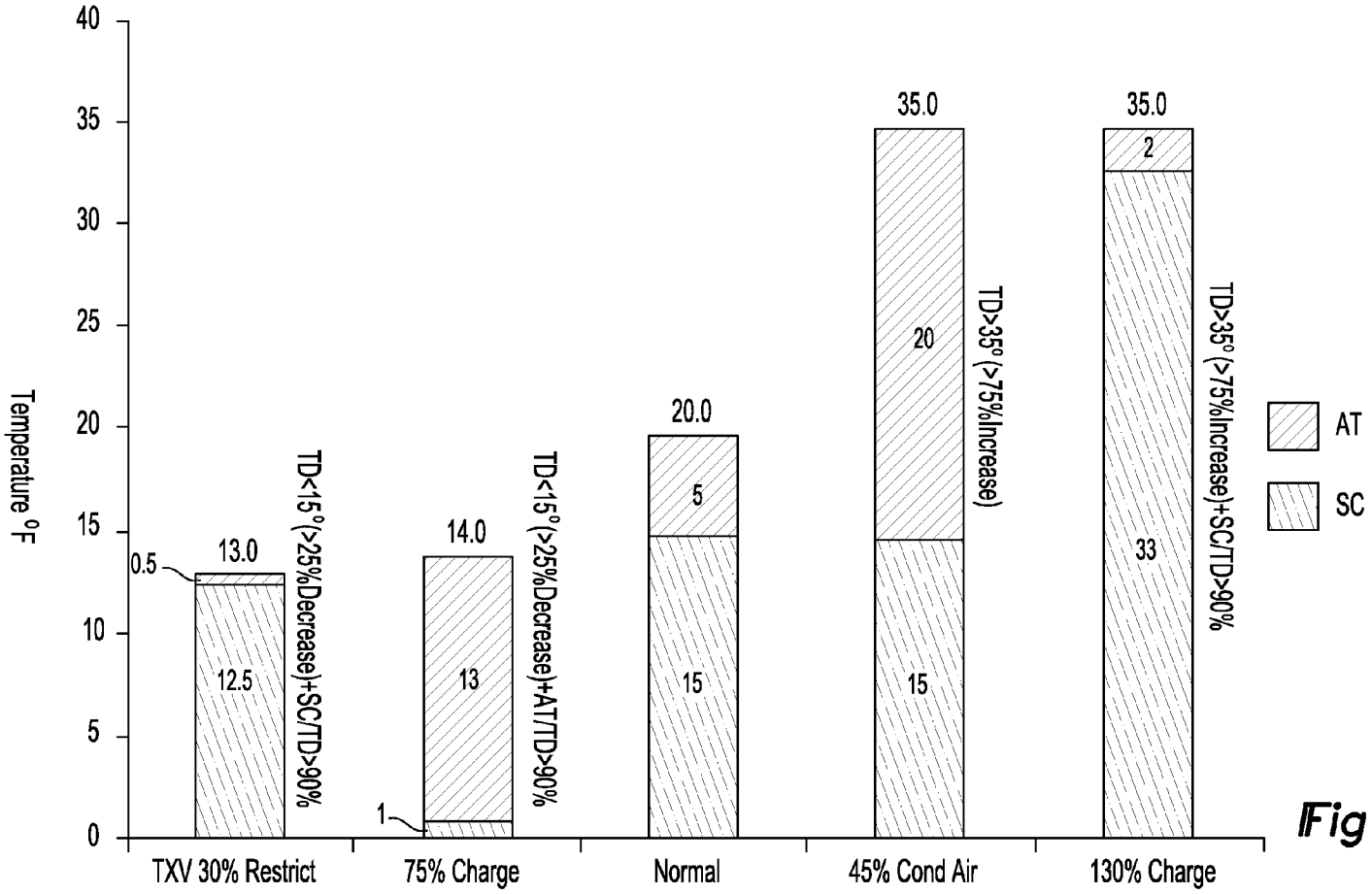
FIG. 9 is a bar graph showing various combinations of condenser temperature difference (TD), subcooling (SC), and approach temperature (AT) at different temperature and refrigerant charge conditions.

With particular reference to FIG. 9, a bar graph detailing different refrigerant charge conditions and other faults for the refrigeration system 12 is provided. Each bar in the graph illustrates the values and/or the relationship among TD, SC, and/or AT for different conditions. For example, the normal charge condition may be declared by the system controller 46 when the following conditions are true: AT≅5° F., SC≅=15° F., and TD≅=AT+SC≅=20° F.

When diagnosing faults in the system, the system controller 46 may perform additional calculations to assist in the diagnosis. For example, the system controller 46 may utilize other data that signifies a particular operating condition to allow the controller 46 to differentiate amongst faults having similar characteristics. For example, the TDs for a one hundred thirty percent (130%) charge (overcharge) condition and a low condenser air flow condition (dirty coil) are both high (for example only, 35° F.). In order to differentiate between these two faults, the system controller 46 may determine a ratio of SC to TD. The controller 46 may declare an overcharge condition when SC/TD is greater than approximately ninety percent (90%), and may declare a low condenser air flow fault (e.g. blocked or dirty condenser coil or condenser fan fault) when SC/TD is less than approximately ninety percent (90%).

The TDs for both a seventy-five percent (75%) charge (undercharge) condition and a thermal expansion valve (TXV) flow control restriction are low (for example only, 14° F. and 13° F., respectively). In order to differentiate between these two faults, the system controller 46 may determine a ratio of AT to TD. The undercharge condition may be declared when the ratio of AT/TD is greater than approximately ninety percent (90%) and the TXV fault may be declared when the ratio of AT/TD is less than approximately ten percent (10%).

As previously described, the coil temperature sensors 58, 62 may be used to determine the charge condition of the refrigeration system 12. This information may be useful when installing a new refrigeration system 12 or, alternatively, when monitoring or charging an existing system 12 following maintenance. In one configuration, the temperature sensors 58, 62 may be used in conjunction with an algorithm that utilizes information from the temperature sensors 58, 62 to aid in providing the refrigeration system 12 with the proper amount of refrigerant.

Figure 8:
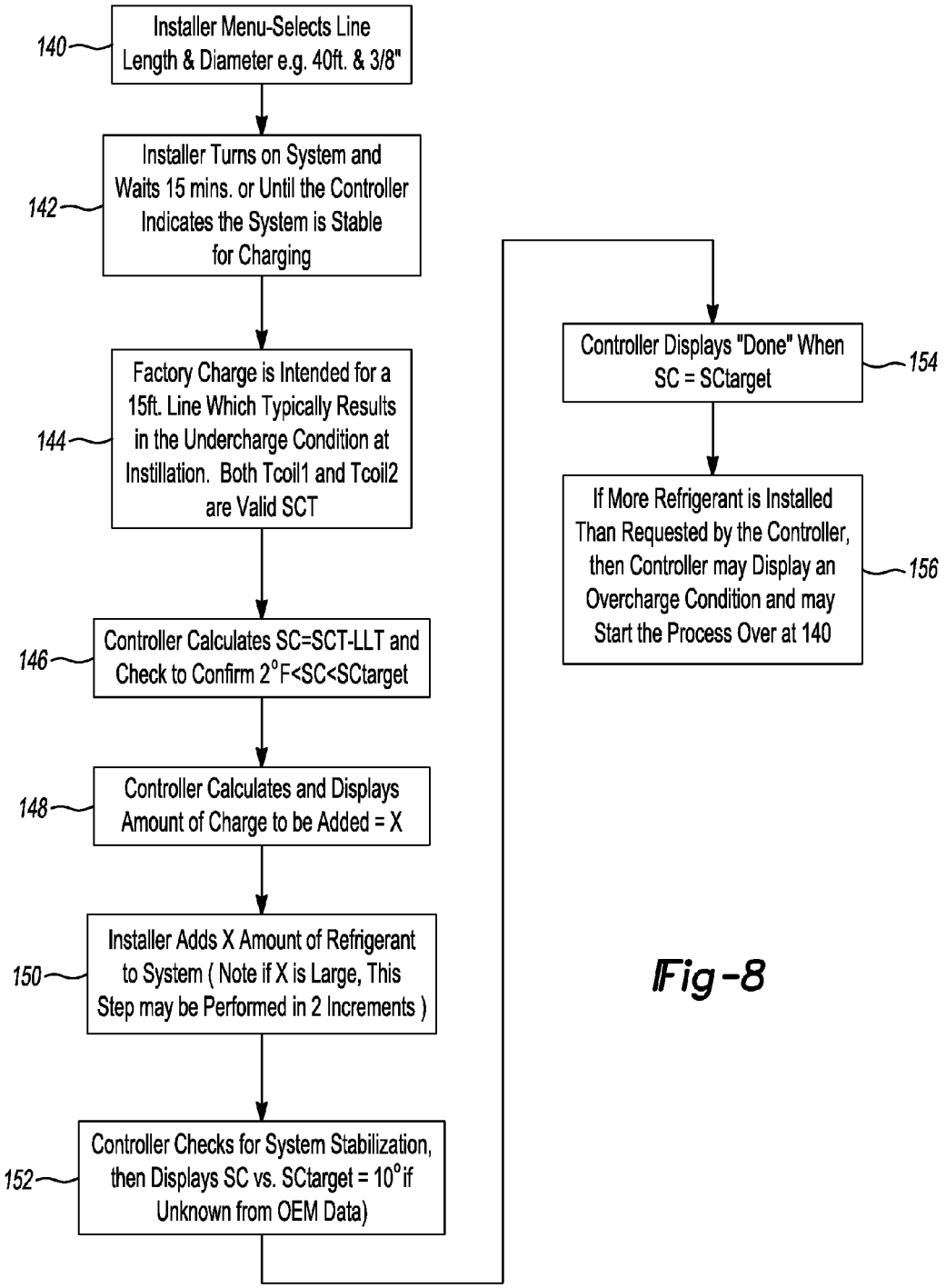
FIG. 8 is a flow chart detailing operation of a device that may operate one or both of the charge-verification systems of FIGS. 6 and 7.

The algorithm may be performed by a computer such as, for example, a hand-held device or a laptop computer (FIG. 8). The computing device may prompt the installer to first select a line length of a refrigeration line set and a diameter of the line set at 140. For example, the line length and diameter may respectively be forty feet and three-eighths of an inch $$\left(40\frac{1}{32}\text{ ft}\right).$$

The installer may power on the system and wait approximately fifteen minutes or until the system controller 46 indicates that the system is stable for charging at 142. Because the factory charge is intended for only fifteen feet (15 ft) of refrigeration line, this particular unit may be undercharged, as described at 144. Thus, both the temperature reading from the first coil temperature sensor 58 and the temperature reading from the second coil temperature sensor 62 are valid SCTs in this situation. The controller 46 may calculate the SC using the formula SC=SCT−LLT and confirm whether approximately two degrees Fahrenheit is less than the SC and whether the SC is less than a target SC (2° F.<SC<SCtarget) at 146, where the target SC is approximately ten degrees Fahrenheit (10° F.). If the target SC is provided from original equipment manufacturer data, the system controller 46 will use this as the target SC instead.

The system controller 46 may calculate and display an amount of charge (X) to be added at 148. The system controller may prompt the installer to add X charge to the system at 150 (if X is large, the addition may be performed in a plurality of increments). The system controller 46 may check for system stabilization and may display the SC versus the target SC on the computing device at 152. When the SC is approximately equal to the target SC, the system controller 46 may indicate that the charge is complete at 154. If the installer adds more charge than requested by the system controller 46, the system controller 46 may determine an overcharge condition and may prompt the installer to recover and start the charge process again at 156.

The charge-verification system 10 and method 100 may also be applied to a split heat pump operating in a heating mode if both the first coil temperature sensor 58 and the second coil temperature sensor 62 are positioned on the indoor coil of the heat pump system. The SCT determined may be used to calculate a Discharge Superheat (DSH). Further, the charge-verification system 10 and method 100 are intended for both initial installation as well as on-going monitoring and maintenance service of the refrigeration system 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Those skilled in the art may now appreciate from the foregoing that the broad teachings of the present disclosure may be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A charge-verification system for a circuit including a compressor and a condenser having an inlet, an outlet, and a coil circuit tube extending between the inlet and the outlet, the charge-verification system comprising:

a first temperature sensor located on said coil circuit tube a first distance from said inlet;

a second temperature sensor located on said coil circuit tube a second distance from said inlet;

a controller receiving a first signal from said first temperature sensor indicative of a first temperature and receiving a second signal from said second temperature sensor indicative of a second temperature, said controller determining which of said first signal and said second signal is closer to an actual saturated condensing temperature of the condenser; and a liquid line temperature sensor providing a signal to said controller indicative of a liquid temperature of a liquid circulating within the circuit, wherein said controller controls the compressor based on one of said first signal and said second signal, and said controller determines a charge condition based on a comparison of at least two of the first temperature, the second temperature, and the liquid temperature.

2. The system of claim 1, wherein said one of said first signal and said second signal is closer to said actual saturated condensing temperature than the other of said first signal and said second signal.

3. The system of claim 1, wherein said first distance is approximately thirty to fifty percent of a total length of the coil circuit tube.

4. The system of claim 3, wherein said first distance is approximately forty percent of said total length of the coil circuit tube.

5. The system of claim 3, wherein said second distance is approximately sixty to ninety percent of said total length of the coil circuit tube.

6. The system of claim 5, wherein said second distance is approximately seventy percent of said total length of the coil circuit tube.

7. The system of claim 1, wherein said controller determines a normal charge condition when said first temperature is greater than said second temperature plus approximately two degrees Fahrenheit and both of said first temperature and said second temperature are greater than said liquid temperature plus approximately seven degrees Fahrenheit.

8. The system of claim 1, wherein said controller determines an overcharge condition when said first temperature is greater than said second temperature plus approximately five degrees Fahrenheit and both of said first temperature and said second temperature are greater than said liquid temperature plus approximately two degrees Fahrenheit.

9. The system of claim 1, wherein said controller determines an undercharge condition when said first temperature is approximately equal to said second temperature.

10. The system of claim 9, wherein said second temperature is approximately equal to said liquid temperature.

11. A method of charge-verification by a controller of a circuit including a condenser having an inlet, an outlet, and a coil circuit tube extending between the inlet and the outlet, the method comprising:

processing, by the controller, a first temperature of the coil circuit tube at a first distance from the inlet of the condenser;

processing, by the controller, a second temperature of the coil circuit tube at a second distance from the inlet of the condenser;

processing, by the controller, a liquid temperature of a liquid circulating within the circuit;

determining, by the controller, which of said first temperature and said second temperature is closer to an actual saturated condensing temperature of the condenser; and determining, by the controller, a charge condition based on a comparison of at least two of the first temperature, the second temperature, and the liquid temperature.

12. The method of claim 11, further comprising controlling a compressor based on one of said first temperature and said second temperature.

13. The method of claim 12, wherein said one of said first temperature and said second temperature is closer to said actual saturated condensing temperature than the other of said first temperature and said second temperature.

14. The method of claim 11, wherein determining said first temperature at said first distance includes determining said first temperature at a first location from the inlet that is approximately thirty to fifty percent of a total length of the coil circuit tube.

15. The method of claim 14, wherein determining said second temperature at said second distance includes determining said second temperature at a second location from the inlet that is approximately sixty to ninety percent of said total length of the coil circuit tube.

16. The method of claim 11, further comprising determining by said controller a normal charge condition when said first temperature is greater than said second temperature plus approximately two degrees Fahrenheit and both of said first temperature and said second temperature are greater than said liquid temperature plus approximately seven degrees Fahrenheit.

17. The method of claim 11, further comprising determining by said controller an overcharge condition when said first temperature is greater than said second temperature plus approximately five degrees Fahrenheit and both of said first temperature and said second temperature are greater than said liquid temperature plus approximately two degrees Fahrenheit.

18. The method of claim 11, further comprising determining by said controller an undercharge condition when said first temperature is approximately equal to said second temperature.

19. A controller performing the method of claim 11.

* * * * *